US007402209B2

(12) United States Patent
Ishida et al.

(10) Patent No.: US 7,402,209 B2
(45) Date of Patent: Jul. 22, 2008

(54) APPARATUS AND METHOD FOR APPLYING COATING LIQUID TO CYLINDRICAL SUBSTRATE, AND ELECTROPHOTOGRAPHIC PHOTORECEPTOR PRODUCED BY THAT METHOD AND ELECTROPHOTOGRAPHIC APPARATUS PROVIDED WITH THE SAME

(75) Inventors: Kazuya Ishida, Kyoto (JP); Takatsugu Obata, Nara (JP); Junichi Washo, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 679 days.

(21) Appl. No.: 10/971,340

(22) Filed: Oct. 22, 2004

(65) Prior Publication Data

US 2007/0054206 A1 Mar. 8, 2007

(30) Foreign Application Priority Data

Oct. 24, 2003 (JP) ..... P2003-364810

(51) Int. Cl.
*B05C 1/08* (2006.01)
*B05D 1/28* (2006.01)

(52) U.S. Cl. ..... 118/211; 118/256; 118/261; 118/DIG. 14; 118/DIG. 15

(58) Field of Classification Search ..... 118/256, 118/261, 211, DIG. 14, DIG. 15; 427/428.14, 427/428.15
See application file for complete search history.

(56) References Cited

U.S. PATENT DOCUMENTS 3,688,736 A * 9/1972 Hansludwig et al. ..... 118/221
4,216,252 A * 8/1980 Moeller ..... 427/387
4,503,802 A * 3/1985 Keller et al. ..... 118/249
5,858,093 A * 1/1999 Saitoh et al. ..... 118/212
6,074,480 A * 6/2000 Kakuta ..... 118/249
6,554,900 B1 * 4/2003 Aydin et al. ..... 118/211

FOREIGN PATENT DOCUMENTS

| | | |
|---|---|---|
| JP | 3-12261 | 1/1991 |
| JP | 11-216405 | 8/1999 |
| JP | 11-276958 | 10/1999 |
| JP | 2000-84472 | 3/2000 |
| JP | 2000-325862 | 11/2000 |
| JP | 2000-325863 | 11/2000 |

* cited by examiner

*Primary Examiner*—Laura Edwards
(74) *Attorney, Agent, or Firm*—Edwards Angell Palmer & Dodge LLP; David G. Conlin; Peter J. Manus

(57) ABSTRACT

A coating liquid to be used for coating has a loss tangent tan δ of from 1 to 10 at a frequency of 6.28 radians/sec. A coating liquid supplying roll has a fine concave portion in at least a part of the circumferential length thereof, and in the vicinities of the both circumferential ends of the fine concave portion, the fine concave portion 8 has concave depth decreasing portions formed in such a manner that the depth of a fine concave decreases. The fine concave portion is constructed in such a manner that the sum L (=L1+L2) of a circumferential length L1 of a portion in which the fine concaves are formed in substantially the same depth and a circumferential length L2 of one concave depth decreasing portion becomes an integral multiple (1 or more) of a circumference Lc of the cylindrical substrate.

2 Claims, 17 Drawing Sheets

APPARATUS AND METHOD FOR APPLYING COATING LIQUID TO CYLINDRICAL SUBSTRATE, AND ELECTROPHOTOGRAPHIC PHOTORECEPTOR PRODUCED BY THAT METHOD AND ELECTROPHOTOGRAPHIC APPARATUS PROVIDED WITH THE SAME

BACKGROUND OF THE INVENTION

1. Field of the Invention

The present invention relates to an apparatus and a method for applying a coating liquid to a cylindrical substrate and to an electrophotographic photoreceptor produced by that method and an electrophotographic apparatus provided with the same.

2. Description of the Related Art

Technologies for applying a coating liquid to a cylindrical substrate have hitherto been employed in various fields. Here, the preparation of an electrophotographic photoreceptor will be hereunder enumerated. Incidentally, even in limiting to the electrographic field, application of a coating liquid to a cylindrical substrate is employed in the preparation of not only electrophotographic photoreceptors but also charging rolls, transfer rolls, fixing rolls, and so on.

The electrophotographic photoreceptor includes ones in which a lamination type photosensitive layer is formed by successively applying a coating material for undercoating layer, a coating material for charge-generating layer and a coating material for charge-transporting layer as coating materials for electrophotographic photoreceptor to the peripheral surface of a hollow cylindrical substrate constituted of aluminum or the like. The photosensitive layer is not only required to have a thin and uniform thickness but also eagerly demanded to realize low costs. Accordingly, a coating method having excellent producibility is being developed and investigated.

As a method of forming a photosensitive layer by applying coating materials for electrophotographic photoreceptor to the peripheral surface of a cylindrical substrate, a spray coating method, a dip coating method, a blade coating method, and so on have hitherto been known. However, these related art coating methods involve such problems that a uniform coating film is not obtained and that the production efficiency is poor.

For example, the spray coating method involves such a problem that when a solvent having a low boiling point is used in the coating material for electrophotographic photoreceptor, the solvent contained in the coating material is vaporized on the way of arrival of the coating material at the peripheral surface of the substrate, whereby the concentration of solids in the coating material increases, and therefore, when the coating material arrives at the substrate, it does not sufficiently spread on the peripheral surface of the substrate, and the surface of the coating film becomes irregular so that a smooth coating film surface is not obtained, whereby a coating film having a uniform thickness is not obtained.

Conversely, when a solvent having a high boiling point is used, though after attachment of the coating material onto the peripheral surface of the substrate, an action for leveling the thickness (hereinafter referred to as "leveling") is revealed, since vaporization of the solvent is slow, fixing of the coating film is delayed. When coating is continued in such a state that the fixing of the coating film is insufficient, in the case where a desired thickness is thick, there is encountered a problem that sagging of the coating material occurs so that a coating film having a uniform thickness is not obtained, either. In order to avoid this problem, the coating material may be dividedly coated several times. However, this method involves such problems that since coating and drying must be repeatedly carried out until the coating film becomes dry to the touch (the state that the coating film becomes dry to a degree that a trace does not remain even by finger touch), a time required for achieving works is long and that steps thereof are extremely complicated.

According to the dip coating method, though smoothness of the coating film surface is improved, the coating film is formed even in the interior and end face of the substrate. The coating film formed in the interior and end face of the substrate becomes an obstacle in installing a flange, etc. in the substrate. Accordingly, in order to formulate a substrate in which a coating film is formed in the interior and end face thereof into a substrate for electrophotographic photoreceptor, there is encountered a problem that the coating film formed in the interior and end face of the substrate must be peeled away. Also, in order to peel away the coating film formed in the interior and end face of the substrate, since a peeling step is necessary, such became a factor for hindering producibility. Further, since the thickness of the coating film is largely affected by physical properties of the coating material and a lifting rate after dipping, when lifting is carried out at a constant rate, a thickness difference between the upper end and the lower end of the substrate is generated. In order to overcome such a thickness difference, it is necessary to control the lifting rate. However, that control is difficult. Also, there is encountered a problem that in order to form a coating film having a uniform thickness, the lifting rate after dipping must be made slow. Thus, high production efficiency was not obtained.

The blade coating method is a coating method in which a blade is aligned in a position closed to the length direction of a substrate, and after making the substrate one revolution, the blade is moved backward. According to the blade coating method, though high producibility is obtained, there is encountered a problem that when the blade is moved backward, a phenomenon wherein a part of the coating film coated on the substrate swells occurs due to a surface tension of the substrate so that the thickness becomes non-uniform by this swelling.

Also, there is a roll coating method other than the foregoing methods. The roll coating method involves a problem caused by special characteristics of a substrate as a material to be coated that it is cylindrical, namely, residence of a coating material generated when a cylindrical substrate as a material to be coated rotates and the once coated surface returns repeatedly to a coating portion makes the thickness non-uniform.

As the related art technology of avoiding this residence of coating material from occurring, there is a method in which at the point of time when a substrate makes one revolution and the entire peripheral surface thereof is coated with a coating material, the substrate is kept away from a roll (see Japanese unexamined Patent Publication JP-A 3-12261 (1991)). However, according ( to the related art technology disclosed in JP-A 3-12261, in the case where the substrate makes only one revolution, there is encountered a problem that not only it is difficult to obtain a uniform coating film, but also a seam of the coating material generated when the substrate is kept away from the roll remains. Further, JP-A 3-12261 discloses a method in which after completion of coating by making the substrate one or more revolutions, the substrate is kept away from the coating material supplying roll, and rotation of the substrate is continued to level the coating film surface. However, this method involves such a problem that the thickness must be precisely controlled in expectation of an amount of the residence of the coating material to be subjected to leveling in advance and the substrate must be kept while rotating for a period of time necessary for achieving leveling, resulting in a lowering of the production efficiency.

Also, though a gravure offset method that has hitherto been employed is excellent as a method of forming a certain specific pattern with good precision, it is concerned with a technology fundamentally different from so-called "coating" of forming a uniform coating film and involves such a problem that when it is intended to form a coating film on a cylindrical substrate, a pattern of a plate remains, or a seam is formed.

SUMMARY OF THE INVENTION

An object of the invention is to provide an apparatus and a method for applying a coating liquid to a cylindrical substrate, from which a coating film that is free from unevenness of the thickness, is seamless and has excellent uniformity can be obtained with high production efficiency.

Another object of the invention is to provide an electrophotographic photoreceptor having a photosensitive layer that is free from unevenness of the thickness, is seamless and has excellent uniformity and an electrophotographic apparatus provided with the same.

The invention provides an apparatus for applying a coating liquid to a cylindrical substrate, comprising:

an applicator roll for applying a coating liquid to a cylindrical substrate, the applicator roll being provided so as to come into contact with the cylindrical substrate;

a coating liquid supplying roll for supplying the coating liquid to the applicator roll, the coating liquid supplying roll having a fine concave portion having a plurality of fine concaves formed therein in at least a part of a circumferential length thereof, and the fine concave portion being formed in such a manner that depths of fine concaves in vicinities of both circumferential ends of the fine concave portion decrease as they become far from a center in a circumferential direction of the fine concave portion; and a coating liquid amount-control member for controlling an amount of the coating liquid attached onto a surface of the coating liquid supplying roll, wherein (a) a loss tangent tan δ (=G"/G'), which is a ratio of loss modulus (G") to a storage modulus (G') of the coating liquid at a frequency of 6.28 radians/sec, is 1 or more and not more than 10; and (b) in the fine concave portion of the coating liquid supplying roll, a sum L (=L1+L2) of a circumferential length L1 of a portion in which fine concaves are formed in substantially a same depth and a circumferential length L2 of one of portions in which fine concaves are formed in such a manner that the depth decreases, is n times of a circumference LC of the cylindrical substrate, wherein n is an integer of 1 or more.

In addition, in the invention, the fine concaves are formed in a quadrangular pyramid shape.

Further, in the invention, the cylindrical substrate is a substrate for electrophotographic photoreceptor.

Furthermore, the invention provides a method for applying a coating liquid to a cylindrical substrate, comprising:

providing a coating liquid having a loss tangent tan δ (=G"/G'), which is a ratio of a loss modulus (G") to a storage modulus (G') of the coating liquid at a frequency of 6.28 radians/sec, is 1 or more and not more than 10;

attaching the coating liquid onto a surface of a coating liquid supplying roll, the coating liquid supplying roll having a fine concave portion having a plurality of fine concaves formed therein in at least a part of a circumferential length thereof, which fine concave portion is formed in such a manner that depths of fine concaves in vicinities of both circumferential ends of the fine concave portion decrease as they become far from a center in a circumferential direction of the fine concave portion, and in the fine concave portion of the coating liquid supplying roll, a sum L (=L1+L2) of a circumferential length L1 of a portion formed in substantially a same depth and a circumferential length, L2 of one of portions in which fine concaves are formed in such a manner that the depth decreases, being n times of a circumference Lc of the cylindrical substrate, wherein n is an integer of 1 or more;

controlling an amount of the coating liquid attached onto the surface of the coating liquid supplying roll to a predetermined amount;

supplying the coating liquid to an applicator roll from the coating liquid supplying roll in which the amount of the coating liquid is controlled; and applying the coating liquid from the applicator roll in such a manner that it is contact-transferred onto the cylindrical substrate.

Furthermore, the invention provides an electrophotographic photoreceptor comprising a cylindrical substrate as a substrate for electrophotographic photoreceptor, which is produced by the foregoing method for applying the coating liquid to the cylindrical substrate.

Furthermore, the invention provides an electrophotographic apparatus provided with the foregoing electrophotographic photoreceptor.

According to the invention, the apparatus is constituted so as to set up a loss tangent of a coating liquid at a value falling with an appropriate range, to provide a coating liquid supplying roll in which a plurality of fine concaves are formed on the surface thereof under prescribed conditions, to supply the coating liquid into an applicator roll from the coating liquid supplying roll, and to contact-transfer the coating liquid onto a cylindrical substrate from the applicator roll. Thereby, the apparatus for applying a coating liquid to the cylindrical substrate, from which a coating film that is free from unevenness of the thickness, is seamless and has excellent uniformity can be formed on the surface of the cylindrical substrate, is realized.

In addition, according to the invention, the fine concaves are formed in a quadrangular pyramid shape, and therefore, supply of the coating liquid into the applicator roll from the coating liquid supplying roll is efficiently carried out without waste.

Further, according to the invention, the substrate for electrophotographic photoreceptor is used as the cylindrical substrate. Therefore, by applying the coating liquid for photoreceptor to the surface of the substrate for electrophotographic photoreceptor, an electrophotographic photoreceptor having a photosensitive layer that is free from unevenness of the thickness, is seamless and has excellent uniformity is provided.

Furthermore, according to the invention, a method for applying a coating liquid to a cylindrical substrate, from which a coating film that is free from unevenness of the thickness, is seamless and has excellent uniformity can be obtained with high production efficiency, is realized.

Furthermore, according to the invention, it is possible to produce an electrophotographic photoreceptor having a photosensitive layer that is free from unevenness of the thickness, is seamless and has excellent uniformity can be obtained with high production efficiency using a substrate for electrophotographic photoreceptor as a cylindrical substrate.

Furthermore, according to the invention, an electrophotographic photoreceptor having formed therein a photosensitive layer that is free from unevenness of the thickness, is seamless and has excellent uniformity, and therefore, an electrophotographic apparatus having excellent image quality is realized.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
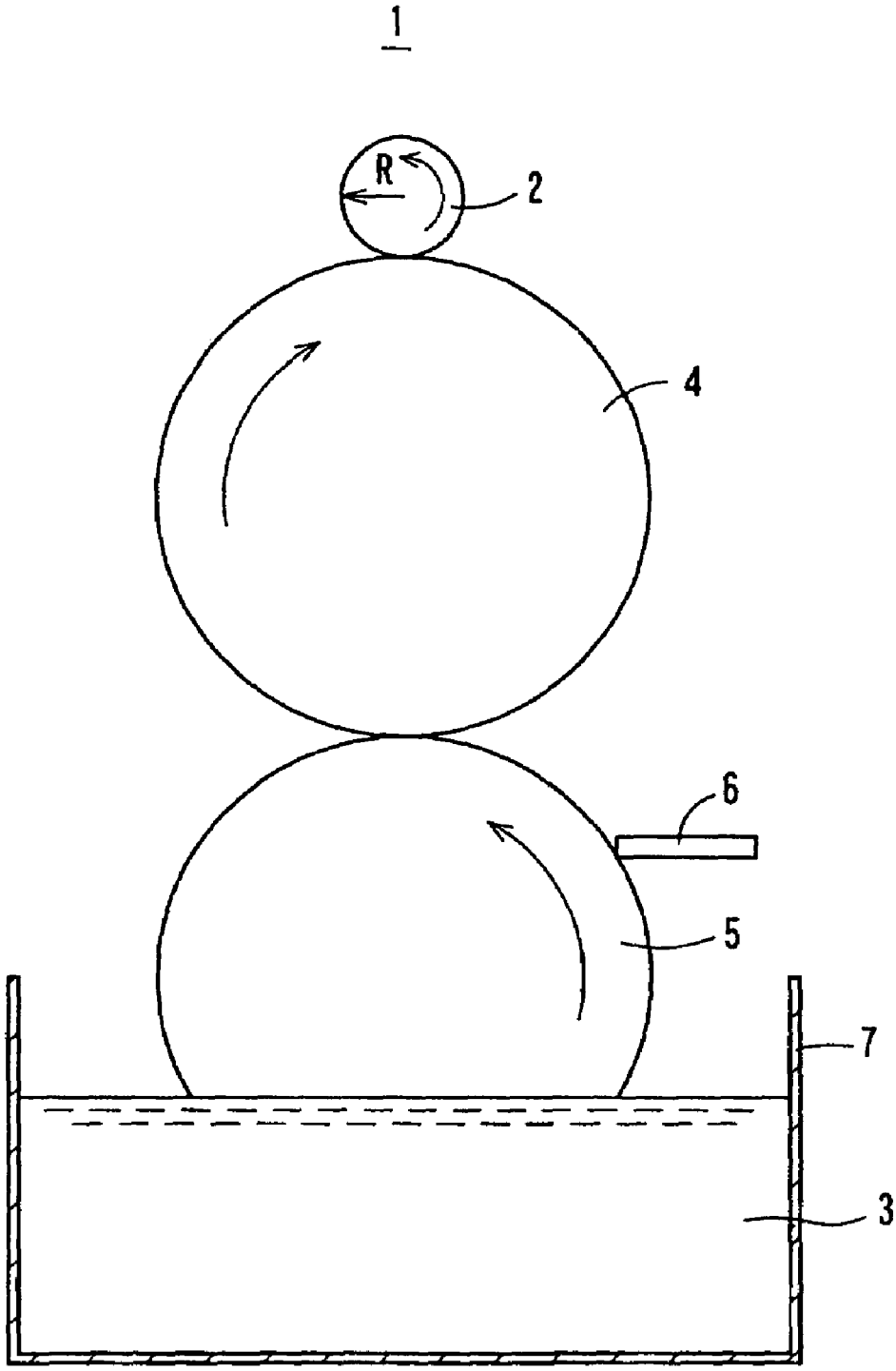
FIG. 1 is a schematic side view showing the construction of an apparatus for applying a coating liquid to a cylindrical substrate according to one embodiment of the invention.

Now referring to the drawings, preferred embodiments of the invention are described below.

FIG. 1 is a schematic side view showing the construction of an apparatus 1 for applying a coating liquid to a cylindrical substrate according to one embodiment of the invention. The apparatus 1 for applying a coating liquid to a cylindrical substrate (hereinafter abbreviated as "coating apparatus 1") includes an applicator roll 4, a coating liquid supplying roll 5, a coating liquid amount-control member 6 and a coating liquid storage tank 7. The applicator roll 4 applies a coating liquid 3 to a cylindrical substrate 2, which is provided so as to come into contact with the cylindrical substrate 2. The coating liquid supplying roll 5 supplies the coating liquid 3 to the applicator roll 4. The coating liquid amount-control member 6 controls an amount of the coating liquid attached onto the surface of the coating liquid supplying roll 5. The coating liquid storage tank 7 stores the coating liquid 3.

Incidentally, the cylindrical substrate 2, the applicator roll 4 and the coating liquid supplying roll 5 are each provided with, for example, a motor and a speed reducing gear train to be connected to the motor as drive means and constructed such that they are rotatably driven, but illustration of the drive means is omitted. Also, the applicator roll 4 and the coating liquid supplying roll 5 are rotatably supported by, for example, a chock, and the cylindrical substrate 2 is rotatably and detachably supported by a support member. However, illustration of these support members is omitted in FIG. 1, too.

The coating apparatus 1 is used for applying the coating liquid 3 to the cylindrical substrate 2 The coating liquid 3 to be used in this coating apparatus 1 is set up in such a manner that a loss tangent tan δ G"/G'), which is a ratio of a loss modulus (G") to a storage modulus (G') of the coating liquid 3 at a frequency of 6.28 radians/sec, is 1 or more and not more than 10.

When an own hardness of a substance is defined as a complex elastic modulus (G*) and its vector is separated on the complex plane into a storage modulus (G') for a real number axis and a loss modulus (G") for an imaginary number axis, respectively, the loss tangent tan δ as referred to herein means a ratio (=G"/G') of the loss modulus (G") corresponding to a viscous component of that substance to the storage modulus (G!) corresponding to an elastic component of that substance.

The loss tangent tan δ is one index to show behavior characteristics of a substance, and it is meant that the smaller the loss tangent tan δ, the stronger the tendency that the subject substance (corresponding to the coating liquid herein) behaves elastically. Conversely, it is meant that the larger the loss tangent tan δ, the stronger the tendency that the subject substance (corresponding to the coating liquid herein) behaves viscously.

In the case of a liquid substance such as the coating liquid, for example, the loss tangent δ can be measured using a rotary rheometer and condition shown in Table 1.

TABLE 1

| | |
|---|---|
| Name of apparatus | Control stress rheometer AR1000 (manufactured by TA Instruments) |
| Geometry | Parallel plates having a diameter of 60 mm |
| Measurement gap | 0.5 mm |
| Measurement temperature | 20° C. |
| Stress | Within previously measured linear elastic region |

The reasons why the range of the loss tangent tan δ of the coating liquid 3 is limited will be hereunder described. When the loss tangent tan δ exceeds 10, since the viscous nature (as a liquid) is too strong, a part of the coating liquid is not transferred into the cylindrical substrate from the applicator roll, and the coating liquid remains on the applicator roll. Since it is impossible to control the amount of the coating liquid remaining on the applicator roll, it becomes substantially impossible to control the thickness of the coating film to be formed on the cylindrical substrate, thereby generating a variation of the thickness.

When the loss tangent tan δ is less than 1, since an elastic nature (as a solid) is too strong, after transfer of the whole of the coating liquid into the cylindrical substrate, leveling of the coating liquid is not carried out. Accordingly, a seam and/or unevenness of the thickness is formed.

When the loss tangent tan δ is 1 or more and not more than 10, all of an elastic nature (as a solid) and a viscous nature (as a liquid) are properly exhibited. Accordingly, in contact rotating the applicator roll and the cylindrical substrate, not only the coating liquid is substantially entirely transferred into the cylindrical substrate from the applicator roll by a shear force in the contact portion, but also after transfer of the coating liquid, leveling is sufficiently carried out. Thus, a uniform coating film that is seamless and free from unevenness of the thickness is formed. That is, a coating liquid having both transfer properties onto the cylindrical substrate from the applicator roll and leveling properties on the cylindrical substrate with a good balance is realized.

The cylindrical substrate 2 is a material to be applied, and various materials such as substrates for electrophotographic photoreceptor as described later can be used.

The applicator roll 4 is formed of an elastic body such as rubbers. When an increase of efficiency in transferring the coating liquid on the surface of the applicator roll 4 into the cylindrical substrate 2 is taken into consideration, it is preferred to use a material having low surface energy such as silicone rubbers as a raw material of the applicator roll 4.

Figure 2:
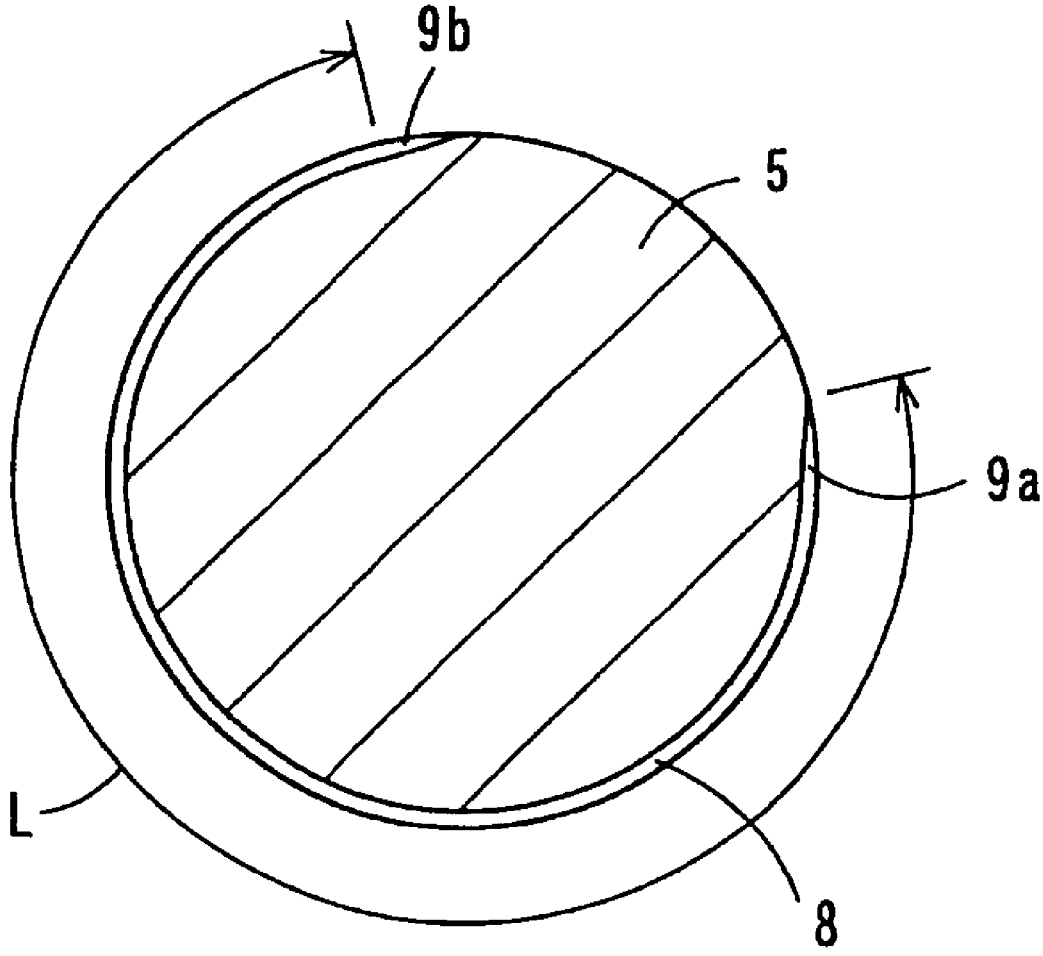
FIG. 2 is a cross-sectional view showing the construction of a coating liquid supplying roll.
Figure 3:
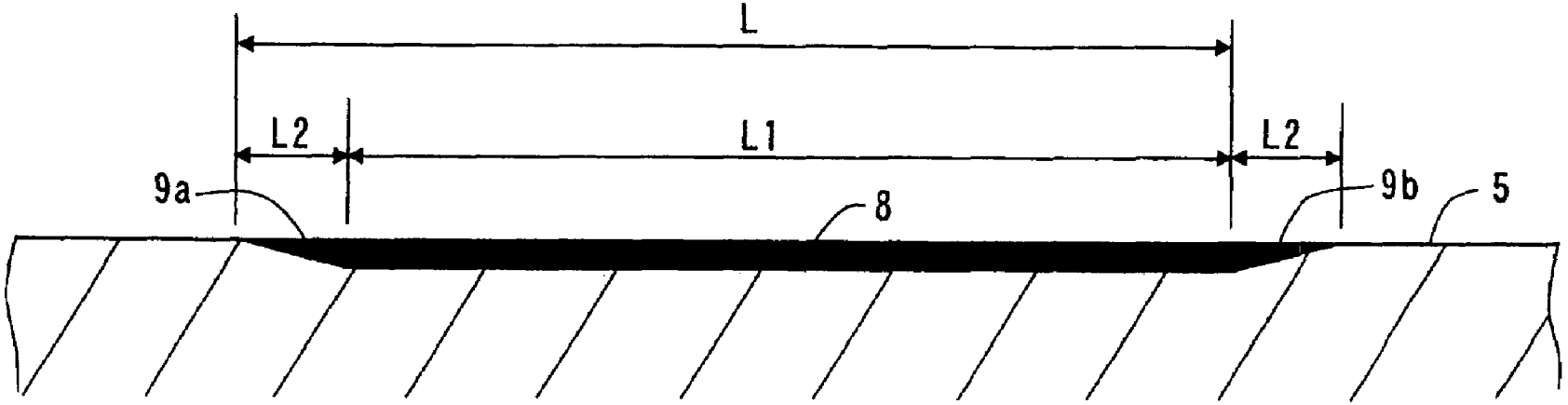
FIG. 3 is a circumferential development elevation in the vicinity of the surface of the coating liquid supplying roll.
Figure 4:
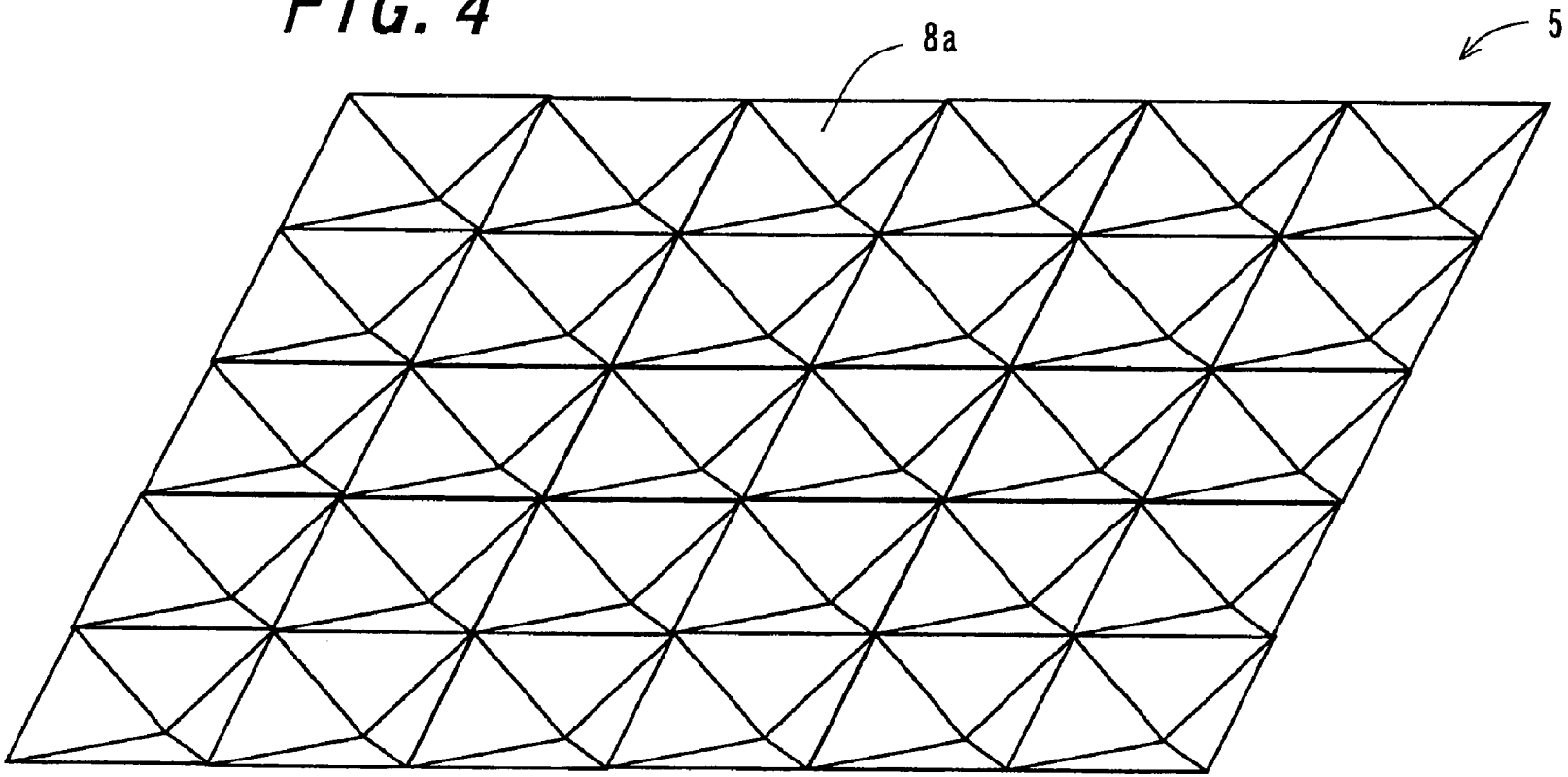
FIG. 4 is an enlarged perspective view of fine concaves to be formed on the surface of the coating liquid supplying roll.

FIG. 2 is a cross-sectional view showing the construction of the coating liquid supplying roll 5; FIG. 3 is a circumferential development elevation in the vicinity of the surface of the coating liquid supplying roll 5; and FIG. 4 is an enlarged perspective view of fine concaves to be formed on the surface of the coating liquid supplying roll 5.

The coating liquid supplying roll 5 is formed of a hard material such as metals. The coating liquid supplying roll 5 has a fine concave portion 8 having a plurality of fine concaves 8*a* formed therein in at least a part of the circumferential length thereof. In the vicinities of the both circumferential ends of the fine concave portion 8, the fine concave portion 8 has concave depth decreasing portions 9*a*, 9*b* in such a manner that the depth of the fine concave 8*a* decreases as it becomes far from the center of the fine concave portion 8 in the circumferential direction.

Here, the effective length L of the fine concave portion 8 is defined as follows. In the fine concave portion 8, the sum L (=L1+L2) of a circumferential length L1 of a portion in which the fine concaves 8*a* are formed in substantially the same depth and a circumferential length L2 of one concave depth decreasing portion 9*a* in which the fine concaves 8*a* are formed in such a manner that the depth decreases is defined as the effective length L. The fine concave portion 8 is formed in such a manner that the effective length L of the coating liquid supplying roll 5 becomes n times of a circumference Lc of the cylindrical substrate 2 (wherein n is an integer of 1 or more), namely, when a radius of the cylindrical substrate 2 is defined as R, the effective length L is satisfactory with an expression, $L=2n\pi R$ (wherein π is the circle ratio).

When the ratio (=L/Lc) of the effective length L to the circumference Lc of the cylindrical substrate 2 is set up at an integral multiple of 1 or more, in the circumferential direction of the cylindrical substrate 2, a difference between the portion to which the coating liquid 3 is supplied from the fine concave portion 8 and the portion to which the coating liquid 3 is not supplied is not generated. Accordingly, a coating film having a uniform thickness is formed in the circumferential direction on the cylindrical substrate 2. In actual application, since the concave depth decreasing portion 9*a* and the concave depth decreasing 9*b* overlap each other with a width of the circumferential length L2, they absorb a subtle position deviation caused by setting up the foregoing ratio (L/Lc) at an integral multiple, thereby substantially playing a role to prevent generation of a seam. It is preferable that the circumferential length L2 of the concave depth decreasing portions 9*a*, 9*b* is set up at from about 1/20 to 1/2 of the circumference (=2πR) of the cylindrical substrate 2.

In this way, by not only forming the concave depth decreasing portions 9*a*, 9*b* in the both circumferential ends of the fine concave portion 8 but also setting up the effective length L of the coating liquid supplying roll 5 at an integral multiple of the circumference (=2πR) of the cylindrical substrate 2, it is possible to form a coating film having a uniform thickness on the surface of the cylindrical substrate 2.

Also, in the embodiment, the fine concave 8*a* is formed in a quadrangular pyramid shape. Preferably, the fine concave 8*a* is formed in such a manner that the base of the quadrangular pyramid is from 10 to 100 μm and that the height of the quadrangular pyramid, i.e., the depth of the fine concave 8*a* is from 10 to 100 μm. For example, the formation of such fine concaves 8*a* can be realized by electrolytically etching a metal-made roll.

In the fine concave 8*a* in a quadrangular pyramid shape, the area in the bottom portion of the quadrangular pyramid coming into contact with the surface of the applicator roll 4 is the maximum, and the cross-sectional area decreases as it becomes far from the surface of the applicator roll 4. Accordingly, in the coating liquid to be held in the fine concave 8*a*, when the applicator roll 4 is brought into contact with the fine concave portion 8 of the coating liquid supplying roll 5, the surface tension of the coating liquid acts strongly such that the coating liquid moves onto the side of the applicator roll 4 rather than it is held in the side of the coating liquid supplying roll 5. Thus, the movement of the coating liquid onto the applicator roll 4 is efficiently carried out without waste.

The coating liquid amount-control member 6 is formed of a raw material such as rubbers and hard plastics and provided so as to come into pressure contact with the coating liquid supplying roll 5, thereby controlling the amount of the coating liquid attached onto the coating liquid supplying roll 5. The coating liquid storage tank 7 is a boxy type vessel made of, for example, stainless steel and stores the coating liquid 3 in an internal space thereof. With respect to the coating liquid 3, one prepared in a separate vessel may be manually poured into the coating liquid storage tank 7, and one may be supplied under pressure through a conduit using a pump or the like and poured into the coating liquid storage tank 7. The coating liquid supplying roll 5 is arranged in such a manner that a part thereof is dipped in the coating liquid 3 to be stored in the coating liquid storage tank 7 and is used for coating by attaching the coating liquid 3 to the part dipped in the coating liquid 3.

The method for applying the coating liquid 3 to the cylindrical substrate 2 using the coating apparatus 1 will be hereunder described. FIGS. 5 to 8 are each a view to explain the operation of the coating apparatus 1. In the coating apparatus 1 of the embodiment, the arrangement is made in such a manner that the applicator roll 4 is brought into pressure contact with the cylindrical substrate 2; that the coating liquid supplying roll 5 is brought into pressure contact with the applicator roll 4; and that the coating liquid amount-control member 6 is brought into pressure contact with the coating liquid supplying roll 5. The cylindrical substrate 2 and the coating liquid supplying roll 5 are rotated in a counterclockwise direction shown by arrows 11 and 12, respectively, and the applicator roll 4 is rotated in a clockwise direction shown by an arrow 13. The coating rate, namely, the peripheral speed of the cylindrical substrate 2, the applicator roll 4 and the coating-liquid supplying roll 5 is suitably in the range of from 1 m/min to 800 m/min, and preferably in the range of from 10 m/min to 300 m/min. When the coating rate is too slow, the producibility is lowered, and on the other hand, when the coating rate is too fast, unevenness of the coating film caused by scattering of the coating liquid 3 or the like is liable to occur.

Figure 5:
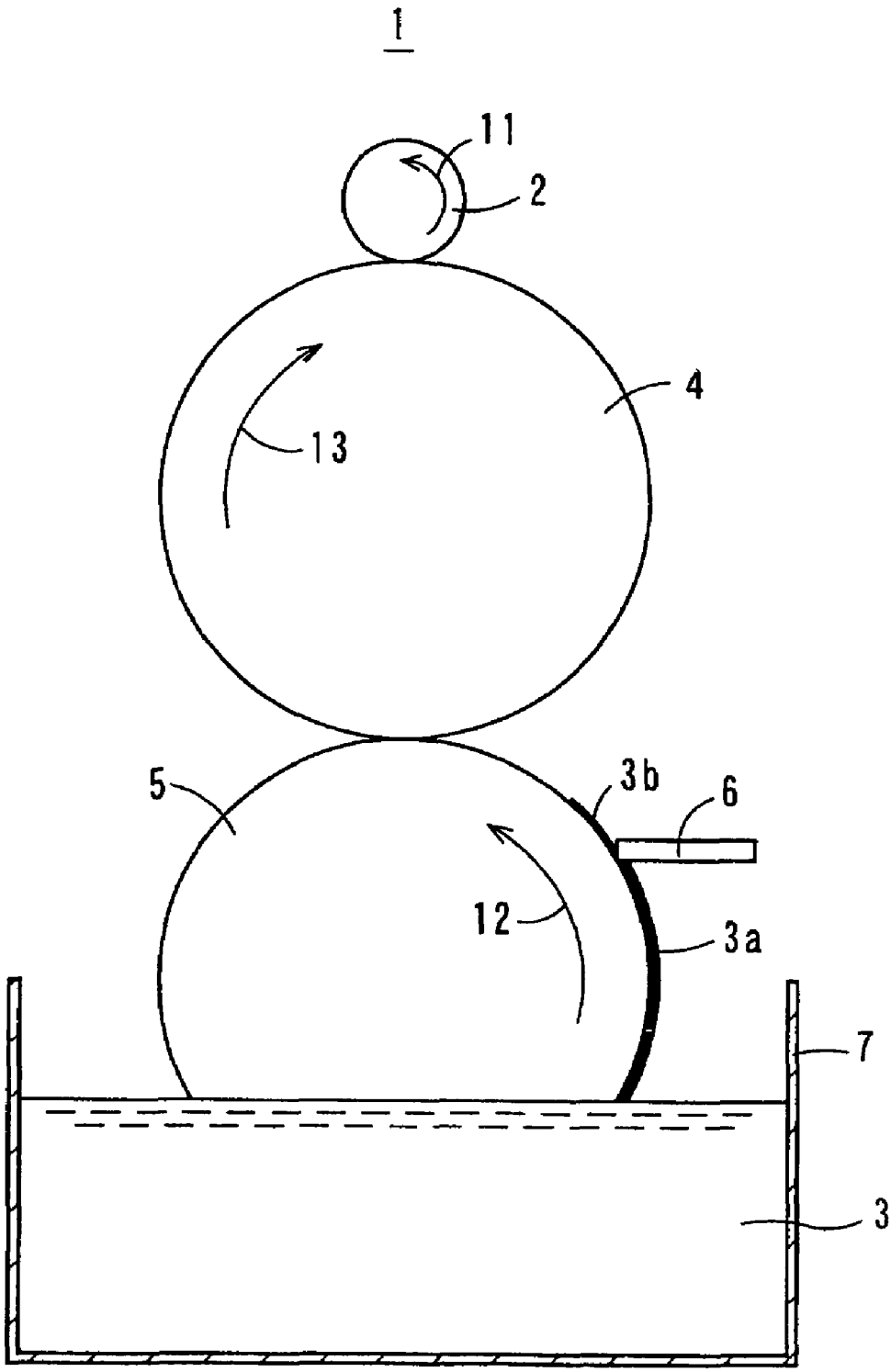
FIG. 5 is a view to explain the operation of the coating apparatus.

In FIG. 5, following the rotation of the coating liquid supplying roll 5 a part of which is dipped in the coating liquid 3 in the coating liquid storage tank 7, a coating liquid 3*a* is supplied into the fine convex portion 8 on the surface of the coating liquid supplying roll 5. The coating liquid 3*a* supplied onto the surface of the coating liquid supplying roll 5 is controlled to a coating liquid 3*b* having a uniform thickness, i.e., a desired amount of the coating liquid by the coating liquid amount-control member 6.

Figure 6:
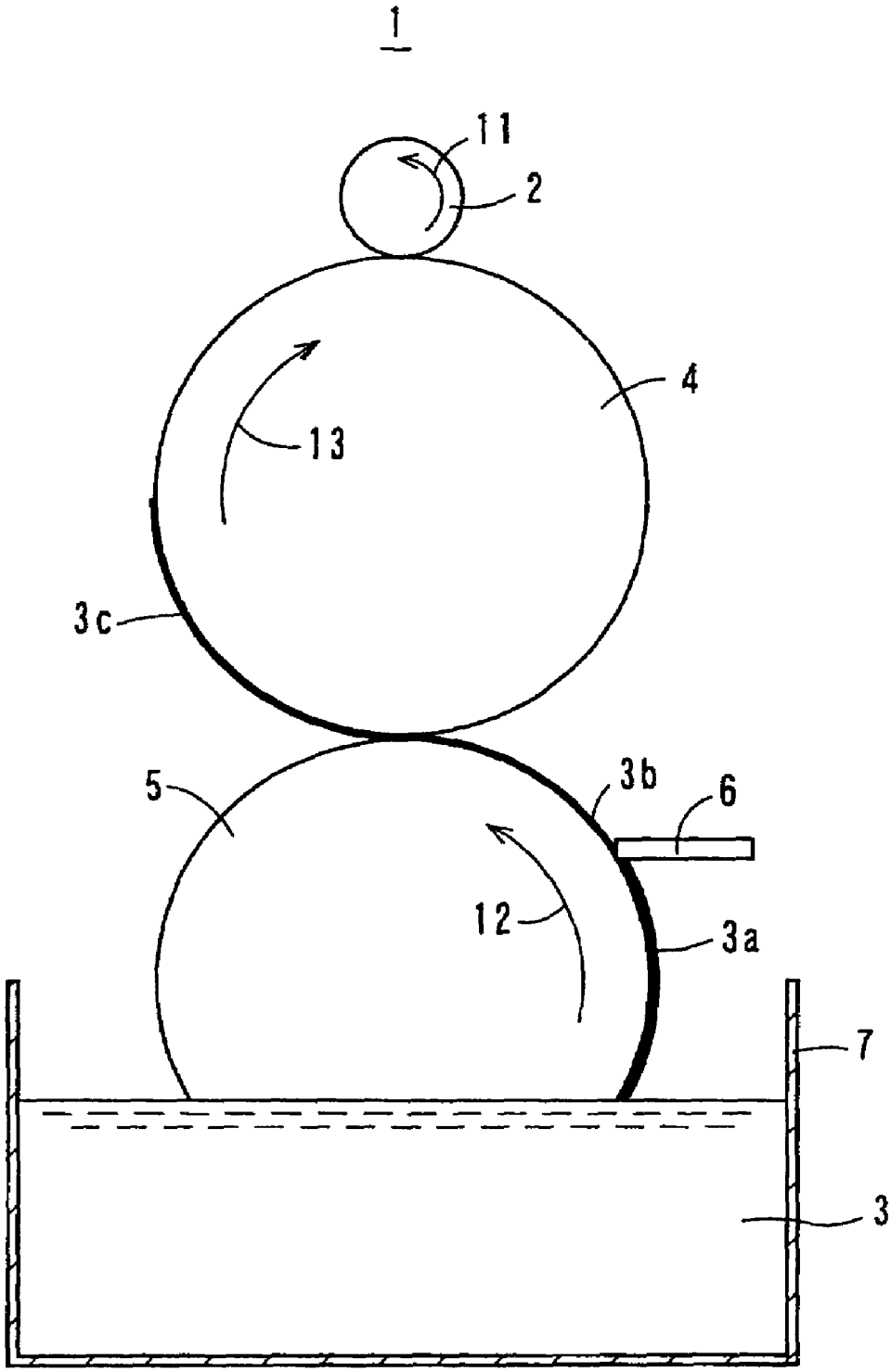
FIG. 6 is a view to explain the operation of the coating apparatus.

In FIG. 6, the coating liquid 3*b* moves onto the surface of the applicator roll 4 provided in such a manner that it is brought into pressure contact with the coating liquid supplying roll 5 and becomes a coating liquid 3*c*.

Figure 7:
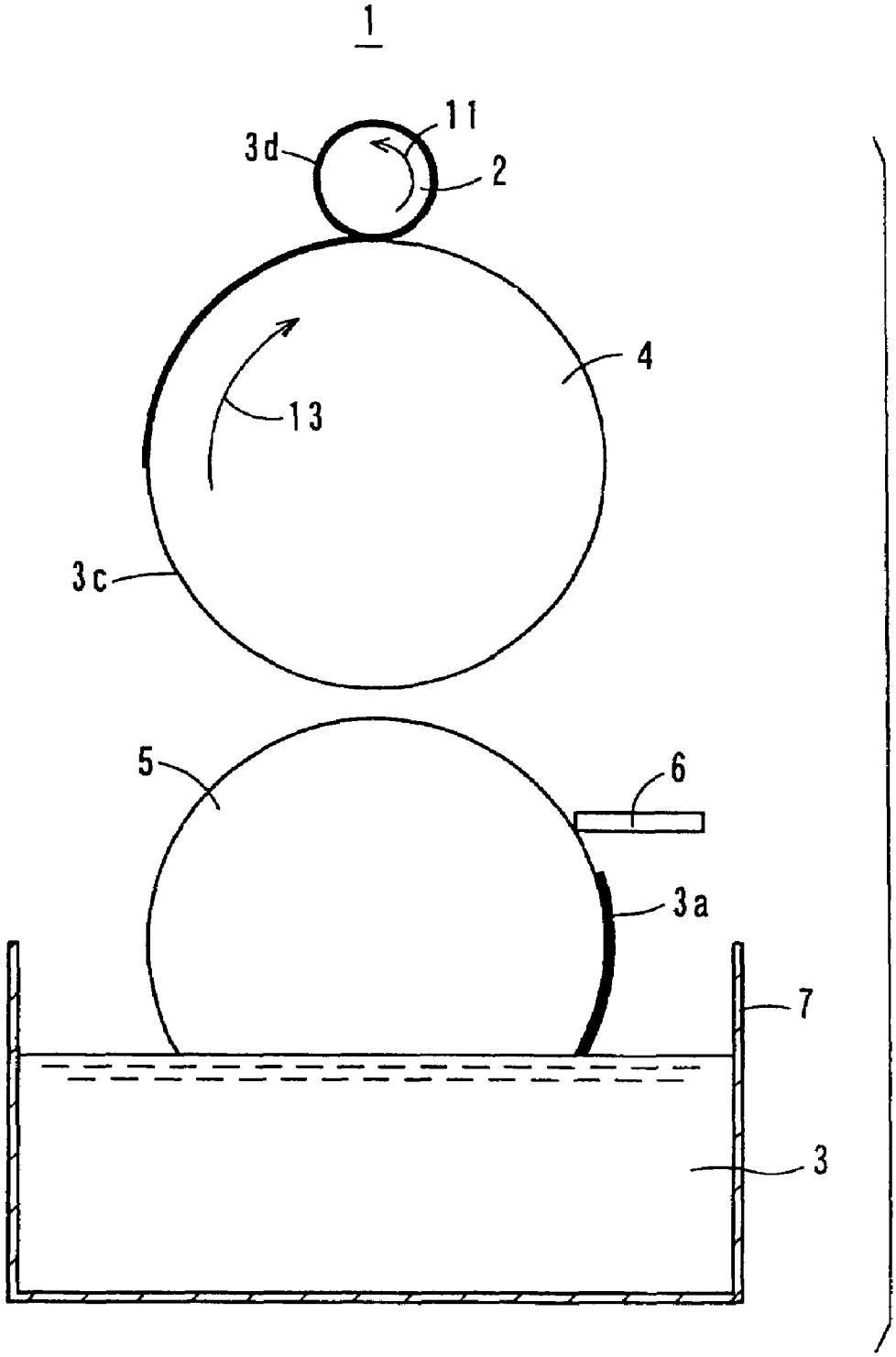
FIG. 7 is a view to explain the operation of the coating apparatus.

In FIG. 7, by continuing the rotation of the applicator roll 4 and the coating liquid supplying roll 5, the whole of the coating liquid 3*b* attached to the fine concave portion 8 of the coating liquid supplying roll 5 moves onto the applicator roll 4. Thereafter, the rotation of the coating liquid supplying roll 5 is stopped, and the pressure contact between the coating liquid supplying roll 5 and the applicator roll 4 is released. Incidentally, the rotation of the applicator roll 4 and the cylindrical substrate 2 is continued, and the coating liquid 3*c* is contact transferred into the cylindrical substrate 2 from the applicator roll 4.

Figure 8:
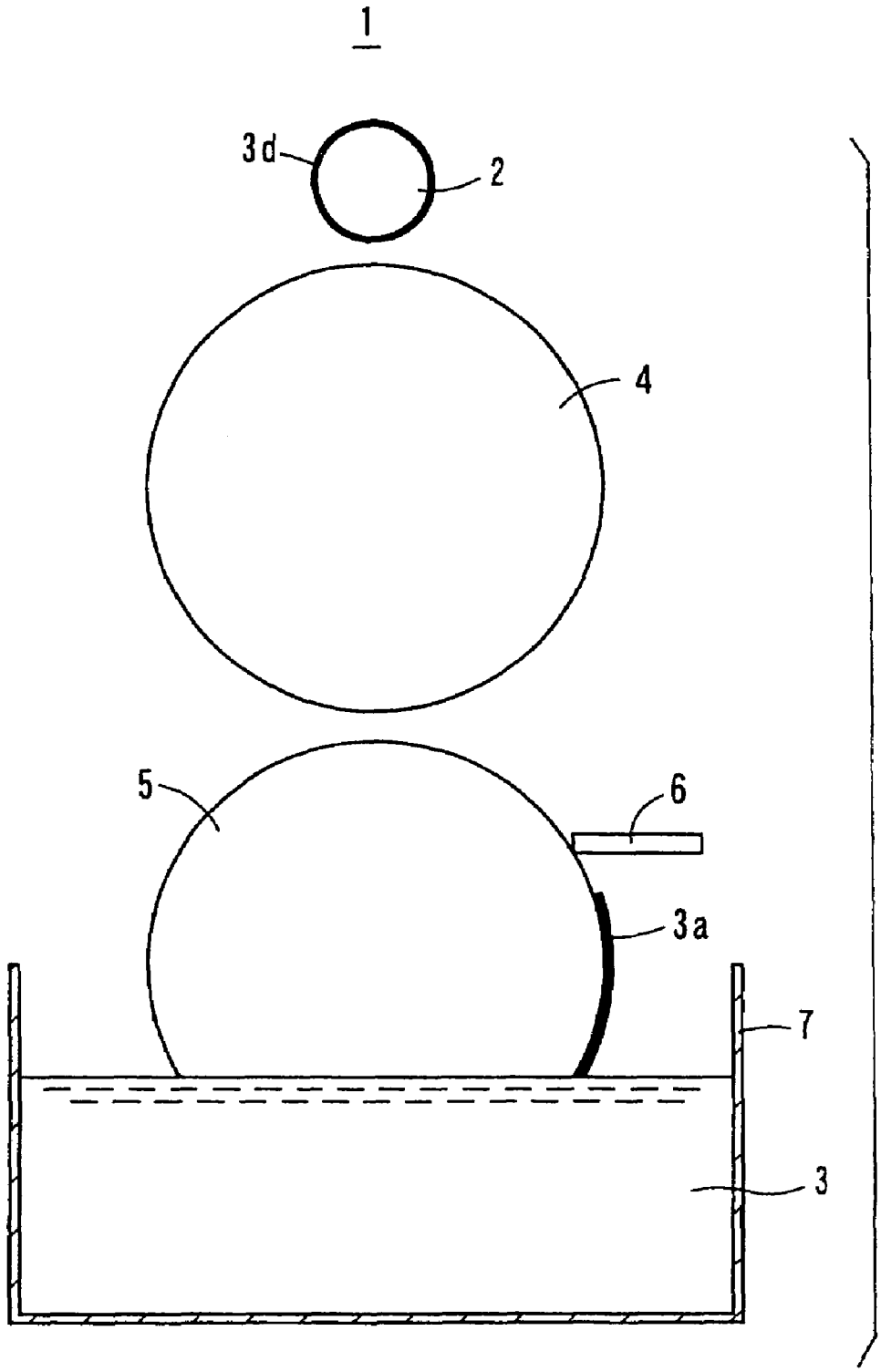
FIG. 8 is a view to explain the operation of the coating apparatus.

In FIG. 8, after transferring the whole of the coating liquid 3*c* onto the surface of the cylindrical substrate 2 from the applicator roll 4, the rotation of the applicator roll 4 and the cylindrical substrate 2 is stopped, and the pressure contact between the cylindrical substrate 2 and the applicator roll 4 is released. In this way, a coating film 3*d* having a uniform thickness is formed on the surface of the cylindrical substrate 2.

In the foregoing description of the operation, in applying the coating liquid 3 to the cylindrical substrate 2, following the movement of the coating liquid, the rotation of the coating liquid supplying roll 5 and the applicator roll 4 is successively stopped, and the pressure contact is released. However, in continuous coating, it is possible to design to make the thickness of the coating film thick by carrying out continuous rotation in the pressure contact state. Also, the coating film may be formed on a plurality of the cylindrical substrate 2 by repeatedly carrying out the foregoing operation by exchanging only the cylindrical substrate 2 one after another.

Next, the production of an electrophotographic photoreceptor as a case in which the coating apparatus 1 and the coating method are suitably used will be hereunder described. That is, using a substrate for electrophotographic photoreceptor as the cylindrical substrate 2 and using a coating liquid for electrophotographic photoreceptor as the coating liquid, the coating liquid for electrophotographic photoreceptor is applied to the substrate for electrophotographic photoreceptor by the coating apparatus 1.

Metal materials such as aluminum, aluminum alloys, copper, zinc, nickel, stainless steel, and titanium can be used as the substrate for electrophotographic photoreceptor. Also, the substrate for electrophotographic photoreceptor is not limited to these metal materials, and high-molecular materials such as polyethylene terephthalate, phenol resins, nylon, and polystyrene, glass, hard papers, and the like can be used. Also, since the substrate for electrophotographic photoreceptor is required to have conductivity on its surface, in the case where the substrate is made of an insulating raw material, it is necessary to carry out lamination of a metal foil, metal vapor deposition treatment, or conductive treatment by coating a conductive substance such as titanium oxide, tin oxide, indium oxide, and carbon black along with an appropriate binder.

The photosensitive layer to be formed by coating the coating liquid for electrophotographic photoreceptor on the surface of the substrate for electrophotographic photoreceptor may be of a single-layer type in which a charge-generating material and a charge-transporting material are present within the same layer or a lamination type in which a layer containing a charge-generating material and a layer containing a charge-transporting material are laminated.

The photosensitive layer of a single-layer type is formed by coating a coating liquid comprising a charge-generating material and a charge-transporting material dispersed or dissolved in a binder resin solution on the peripheral surface of the substrate for electrophotographic photoreceptor and then drying.

The photosensitive layer of a lamination type is obtained by coating a coating liquid prepared by dispersing fine particles of a charge-generating material in a binder resin solution on the peripheral surface of the substrate for electrophotographic photoreceptor and then drying to form a charge-generating layer if desired; and coating a coating liquid comprising a charge-transporting material as a compound having a charge transport function dissolved in a binder resin solution thereon and then drying to form a charge-transporting layer. Also, conversely, the photosensitive layer of a lamination type may be obtained by forming a charge-transporting layer on the peripheral surface of the substrate for electrophotographic photoreceptor and forming a charge-generating layer on the charge-transporting layer.

In the case of a single-layer type electrophotographic photoreceptor, the thickness of the photosensitive layer to be formed on the substrate for electrophotographic photoreceptor is preferably in the range of from 5 to 50 μm, and especially preferably in the range of from 15 to 40 μm. Also, in the case of a lamination type electrophotographic photoreceptor, the thickness of the charge-generating layer is preferably not more than 10 μm, and especially preferably in the range of from 0.1 to 5 μm; and the thickness of the charge-transporting layer is preferably in the range of from 5 to 50 μm, and especially preferably in the range of from 15 to 40 μm.

Examples of the charge-generating material include various organic pigments or dyes such as phthalocyanine based pigments, azo based pigments, quinone based pigments, perylene based pigments, indigo based pigments, thioindigo based pigments, bisbenzimidazole based pigments, quinacridone based pigments, quinoline based pigments, lake pigments, azo lake pigments, anthraquinone based pigments, oxazine based pigments, dioxazine based pigments, triphenylmethane based pigments, azulenium dyes, squalium dyes, pyrylium based dyes, triallylmethane dyes, xanthene dyes, thiazine dyes, and cyanine based dyes; and inorganic materials such as amorphous silicon, amorphous selenium, tellurium, selenium-tellurium alloys, cadmium sulfide, antimony sulfide, zinc oxide, and zinc sulfide.

The charge-generating material is not limited to those enumerated herein. Also, in using the charge-generating material, it can be used singly or in admixture of two or more thereof. In the case of the charge-generating layer prepared by coating a dispersion comprising fine particles of the charge-generating material dispersed in a binder resin solution, if desired and then drying, a formulation ratio of the charge-generating material to the binder resin is preferably in the range of from 10/1 to 1/10, and especially preferably in the range of from 1/1 to 1/3 in terms of weight ratio.

As the charge-transporting material, a hole-transporting material and/or an electron-transporting material can be used. As the hole-transporting material, low-molecular compounds such as pyrene based compounds, carbazole based compounds, hydrazone based compounds, oxazole based compounds, oxadiazole based compounds, pyrazoline based compounds, arylamine based compounds, arylmethane based compounds, benzidine based compounds, thiazole based compounds, stilbene based compounds, and butadiene based compounds are enumerated. Also, high-molecular compounds such as poly-n-vinylcarbazole, halogenated poly-n-vinylcarbazoles, polyvinylpyrene, polyvinylanthracene, polyvinylacridine, pyrene-formaldehyde resins, ethylcarbazole-formaldehyde resins, ethylcarbazole-formaldehyde resins, triphenylmethane polymers, and polysilanes are enumerated.

Examples of the electron-transporting material include organic compounds such as benzoquinone based compounds, tetracyanoethylene based compounds, tetracyanoquinodimethane based compounds, fluorenone based compounds, xanthone based compounds, phenanthraquinone based compounds, phthalic anhydride based compounds, and diphenoquinone based compounds; and inorganic materials such as amorphous silicon, amorphous selenium, tellurium, selenium-tellurium alloys, cadmium sulfide, antimony sulfide, zinc oxide, and zinc sulfide. The charge-transporting material is not limited to those enumerated herein. Also, in using the charge-transporting material, it can be used singly or in admixture of two or more thereof.

It is preferred to use a high-molecular polymer that is hydrophobic and is cable of forming an electrically insulating film as the binder resin. Examples of such a high-molecular polymer include polycarbonates, polyesters, methacrylic resins, acrylic resins, polyvinyl chloride, polyvinylidene chloride, polystyrene, polyvinyl acetate, styrene-butadiene copolymers, vinyldiene chloride-acrylonitrile copolymers, vinyl chloride-vinyl acetate copolymers, vinyl chloride-vinyl acetate-maleic anhydride copolymers, silicon resins, silicon-alkyd resins, phenol-formaldehyde resins, styrene-alkyd resins, poly-N-vinylcarbazole, polyvinylbutyral, polyvinyl formal, and polysulfones. The binder resin is not limited to those enumerated herein. Also, in using the binder resin, it can be used singly or in admixture of two or more thereof.

Also, additives such as a rheology modifier, a plasticizer, a sensitizer, and a surface modifier may be used together with such a binder resin.

Examples of the rheology modifier include fine particles of titanium oxide, barium sulfate, silica, zinc oxide, etc.; fluidity modifiers such as amide based fluidity modifiers and castor oil based fluidity modifiers; and thickeners.

Examples of the plasticizer include biphenyl, biphenyl chloride, o-terphenyl, dibutyl phthalate, diethylene glycol phthalate, dioctyl phthalate, triphenyl phosphate, methylnaphthalene, benzophenone, chlorinated paraffin, and various fluorohydrocarbons.

Examples of the sensitizer include chloranil, tetracyanoethylene, Methyl Violet, Rhodamine B, cyanine dyes, merocyanine dyes, pyrylium dyes, and thiapyrylium dyes. Examples of the surface modifier include silicone oil and fluorine resins.

For the purposes of not only enhancing adhesion between the substrate for electrophotographic photoreceptor and the photosensitive layer but also preventing injection of a free charge into the photosensitive layer from the substrate for electro-photoreceptor, an adhesive layer or a barrier layer (hereinafter referred to as "undercoating layer") may be provided between the substrate for electrophotographic photoreceptor and the photosensitive layer, if desired.

As a material to be used in the undercoating layer, besides the foregoing high-molecular compounds to be used for the binder, casein, gelatin, polyvinyl alcohol, ethyl cellulose, phenol resins, polyamides, polyimides, carboxymethyl cellulose, vinyldiene chloride based polymer latexes, polyurethanes, aluminum oxide, tin oxide, and titanium oxide are enumerated.

The substance capable of imparting a function as an adhesive or a barrier to the undercoating layer is not limited to those enumerated herein, and other known substances may be used. In using such a substance, it can be used singly or in admixture of two or more thereof. In the case of providing an undercoating layer, its thickness may be 0.005 μm or more and not more than 12 μm and is preferably 0.01 μm or more and not more than 2 μm.

In preparing the coating liquid for electrophotographic photoreceptor, in the case where the charge-generating material and charge-transporting material are dispersed and dissolved in the binder resin solution, a solvent capable of dissolving the binder resin therein is selected among solvents which do not dissolve a layer formed as the lower layer therein. Specific examples of the solvent include alcohols such as methanol, ethanol, n-propanol, and benzyl alcohol; ketones such as acetone, methyl ethyl ketone, cyclohexanone, isophorone, and acetylacetone; amides such as N,N-dimethylformamide and N,N-diemethylacetamide; ethers such as tetrahydrofuran, dioxane, methyl cellosolve, and diglyme; esters such as methyl acetate, ethyl acetate, and diethyl carbonate; sulfones such as dimethyl sulfoxide and sulfolane; aliphatic halogenated hydrocarbons such as methylene chloride, chloroform, carbon tetrachloride, and 1,1,2-trichloroethane; and aromatic compounds such as benzene, toluene, o-xylene, p-xylene, m-xylene, monochlorobenzene, and dichlorobenzene. The solvent is not limited to those enumerated herein. Also, in using the solvent, it can be used alone or in mixture of two or more thereof.

Figure 9:
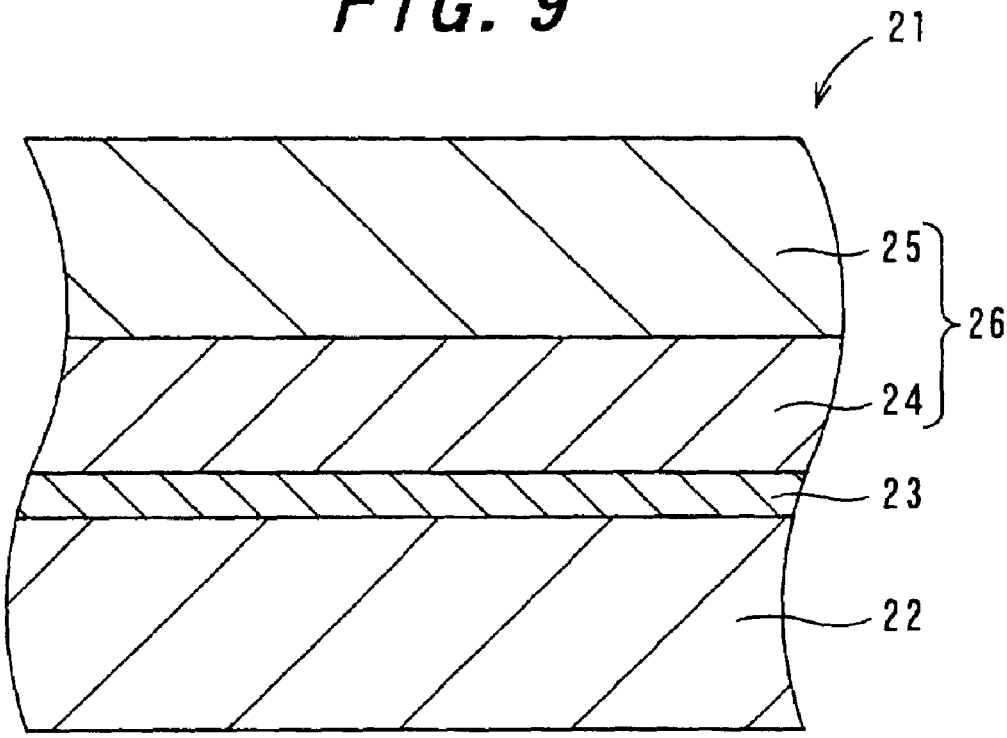
FIG. 9 is a simplified partial cross-sectional view showing the construction of an electrophotographic photoreceptor.

FIG. 9 is a simplified partial cross-sectional view showing the construction of an electrophotographic photoreceptor 21. FIG. 9 shows an example of the construction of a lamination type electrophotographic photoreceptor 21 prepared by coating a coating liquid for electrophotographic photoreceptor on a substrate 22 for electrophotographic photoreceptor by the coating method using the coating apparatus 1. The electrophotographic photoreceptor 21 is provided with an undercoating layer 23. The undercoating layer 23 is formed by applying a coating liquid for undercoating layer to the surface of the substrate 22 for electrophotographic photoreceptor and then drying. A coating liquid for charge-generating layer is coated on the undercoating layer 23 and dried to form a charge-generating layer 24. Further, a coating liquid for charge-transporting layer is applied to the charge-generating layer 24 and dried to form a charge-transporting layer 25. The formed charge-generating layer 24 and charge-transporting layer 25 construct a photosensitive layer 26.

The coating liquid for undercoating layer, the coating liquid for charge-generating layer and the coating liquid for charge-transporting layer, each of which is a coating liquid for electrophotographic photoreceptor, are each adjusted so as to have a loss tangent tan δ of 1 or more and not more than 10.

The adjustment of the loss tangent tan δ of each coating liquid can be, for example, carried out by coating $SiO_2$ nonaparticles such as AEROSIL (a trade name, manufactured by Nippon Aerosil Co., Ltd.) or adding a rheology modifier such as a variety of thixotropy imparting agents.

The coating liquids having been adjusted so as to have a desired loss tangent tan δ are each coated using the coating apparatus 1 by the coating methods described in FIGS. 5 to 8, to form coating films of the respective layers. The thus prepared electrophotographic photoreceptor 21 has the photosensitive layer 26 that is free from unevenness of the thickness, is seamless and has excellent uniformity.

Figure 10:
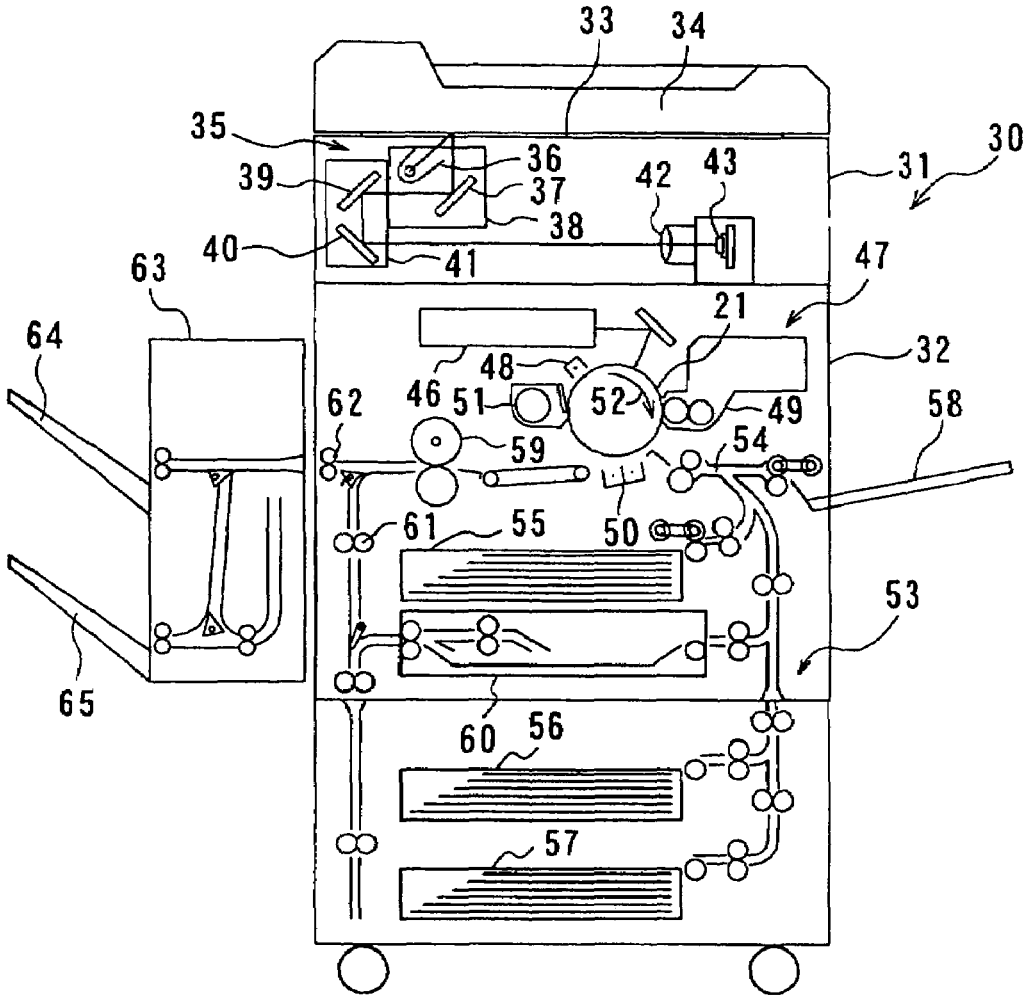
FIG. 10 is a simplified arrangement side view showing the construction of an electrophotographic apparatus provided with the electrophotographic photoreceptor of the invention.

FIG. 10 is a simplified arrangement side view showing the construction of an electrophotographic apparatus 30 provided with the electrophotographic photoreceptor 21 of the invention. The construction and operation of the electrophotographic apparatus 30 provided with the electrophotographic photoreceptor 21 of the invention will be hereunder described with reference to FIG. 10. One exemplified herein as the electrophotographic apparatus 30 is a copier 30.

The copier 30 is roughly a construction including a scanner section 31 and a laser recording section 32. The scanner section 31 includes an original platen 33 made of a light-transmitting glass, a reversing automatic document feeder (RADF) 34 and a scanner unit 35 which is an original image reading unit. The RADF 34 automatically feeds and delivers an original onto the original platen 33. The scanner unit 35 scans and reads an original image placed on the original platen 33. The original image read by the scanner section 31 is sent as an image data to an image data input section, and the image data is subjected to a prescribed image processing. As to the RADF 34, a plurality of sheets of originals are set at once on an original tray (not shown) equipped in the RADF 34. The RADF 34 is a unit which automatically feeds the originals thus set onto the original platen 33 piece by piece. Also, the RADF 34 is constructed of a transporting path for a single-sided original, a transporting path for a double-sided original, transporting path switching means, a sensor group for grasping and managing the state of the original passing through each section, a control section, and so on so as to make the scanner unit 35 read a single side or double sides of the original depending upon selection of an operator.

The scanner unit 35 includes a lamp reflector assembly 36, a first scanning unit 38, a second scanning unit 41, an optical lens 42 and a photoelectric conversion element (a CCD image sensor) 43. The lamp reflector assembly 36 exposes the original surface. The first scanning unit 38 mounts a first reflecting mirror 37 for reflecting reflected light from the original for the purpose of guiding a reflected light image from the original into the CCD image sensor 43. The second scanning unit 41 mounts second and third reflecting mirrors 39 and 40 for guiding a reflected light image from the first reflecting mirror 37 into the CCD image sensor 43. The optical lens 42 allows a reflected light image from the original to be focused on the CCD 43 image sensor for converting the reflected light image into an electric image signal through the respective reflecting mirrors 37, 39 and 40. The CCD 43 image sensor receives the reflected light image from the original and converts it into an electric image signal corresponding to the reflected light image.

The scanner section 31 is constructed so as to not only successively feed and place originals to be read on the original platen 33 due to the associated operation of the RADF 34 and the scanner unit 35 but also move the scanner unit 35 along the lower side of the original platen 33 to read an original image. The first scanning unit 38 is scanned at a constant rate V in the reading direction of the original image (from the left side to the right side against the paper face in FIG. 10) along the original platen 33, and the second scanning unit 41 is scanned in parallel in the same direction at a rate of 2/1 of the rate V (i.e., V/2). By the operation of the first and second units 38, 41, the original image placed on the original platen 33 can be successively image formed every one line onto the CCD image sensor 43 to read the image.

The image data obtained by reading the original image by the scanner unit 35 is sent to an image processing section, subjected to a variety of image processing. Thereafter, the image data subjected to a variety of image processing is once stored in a memory of the image processing section. In order to form an image on recording paper as a recording medium, the image data within the memory is read out in response to an output instruction and transferred into the laser recording section 32.

The laser recording section 32 is provided with a transporting system 53 of recording paper, a laser writing unit 46, and an electrophotographic process section 47 for forming an image. The laser writing unit 46 includes a semiconductor laser light source, a polygon mirror, an f-θ lens and so on. The semiconductor laser light source emits laser light in response to an image data which has been read by the scanner unit 35, stored in the memory and then read out from the memory, or an image data transferred from an external unit The polygon mirror deflects laser light at a conformal speed. The f-θ lens corrects the laser light deflected at a conformal speed such that it is deflected at a conformal speed on the electrophotographic photoreceptor 21 to be provided in the electrophotographic process section 47.

The electrophotographic process section 47 is provided with a charger 48 in the surrounding of the electrophotographic photoreceptor 21, a developing unit 49 as developing means, a transfer unit 50 as transfer means and a cleaning unit 51 as cleaning means in that order from the upper stream side toward the lower stream side in the rotation direction of the electrophotographic photoreceptor 21 shown by an arrow 52. The electrophotographic photoreceptor 21 is uniformly charged by the charger 48 and exposed with laser light corresponding to the original image data emitted from the laser writing unit 46 in the charged state. An electrostatic latent image formed on the surface of the electrophotographic photoreceptor 21 upon exposure is developed with a toner fed from the developing unit 49 to become a toner image as a visible image. The toner image formed on the surface of the electrophotographic photoreceptor 21 is transferred onto recording paper to be fed by the transporting system 53 as described later by the transfer unit 50.

The transporting system 53 of recording paper includes a transporting section 54, first to third cassette paper feeders 55, 56 and 57, a manual paper feeder 58, a fixing unit 59 and a refeed path 60. The transporting section 54 transports recording paper especially at the transfer position at which the transfer unit 50 is arranged-in the electrophotographic process section 47 for carrying out image formation. The first to third cassette paper feeders 55, 56 and 57 send recording paper into the transporting section 54. The manual paper feeder 58 properly feeds recording paper having a desired size. The fixing unit 59 fixes an image transferred onto recording paper from the electrophotographic photoreceptor 21, especially a toner image. The refeed path 60 refeeds recording paper for further forming an image on the back side of recording paper after toner image fixing (side opposite to the surface on which the toner image is formed). A number of transporting rollers 61 are provided on the transporting path of the transporting system 53, and the recording paper is transported at a prescribed position within the transporting system 53 by the transporting rollers 61.

The recording paper having a toner image fixed thereon by the fixing unit 59 is fed into the refeed path 60 for the purpose of forming an image on the back side, or fed into a post processing unit 63 by paper discharge rollers 62. The recording paper fed into the refeed path 60 is repeatedly subjected to the foregoing operations to form an image on the back side. The recording paper fed into the post processing unit 63 is subjected to post processing and discharged into either one of a first discharge cassette 64 or a second discharge cassette 65 as a paper discharge destination to be defined according to the post processing step. Thus, a series of image forming operations in the copier 30 is completed.

Since the copier 30 is provided with the electrophotographic photoreceptor 21 having the photosensitive layer 26 that is free from unevenness of the thickness, is seamless and has excellent uniformity, an image having excellent quality can be formed.

EXAMPLES

Examples of the invention will be hereunder described. Incidentally, in the Examples, though the preparation of electrophotographic photoreceptors is enumerated, the invention is never limited to the electrophotographic photoreceptors but can be used for applying a coating liquid to a cylindrical substrate in other fields.

(Preparation of Coating Liquid)

Coating liquids A1 to E1 for charge-generating layer and coating liquids A2 to E2 for charge-transporting layer were prepared in the following manners.

[Coating Liquid A1 for Charge-Generating Layer]

Materials shown in Table 2 were dispersed in a homogenizer for 10 minutes to prepare a coating liquid A1 for charge-generating layer.

TABLE 2

| | |
|---|---|
| Non-metal phthalocyanine (Fastogen Blue 8120BS, manufactured by Dainippon Ink and Chemicals Incorporated): | 1.6 parts by weight |
| AEROSIL R972 (manufactured by Nippon Aerosil Co., Ltd.): | 0.5 parts by weight |
| Polycarbonate resin Z800 (manufactured by Mitsubishi Gas Chemical Company, Inc.): | 8.5 parts by weight |
| Hole-transporting material represented by the following structural formula (I): | 6 parts by weight |
| Electron-transporting material represented by the following structural formula (II): | 1.5 parts by weight |
| Cyclohexanone: | 150 parts by weight |

[Formula 1]

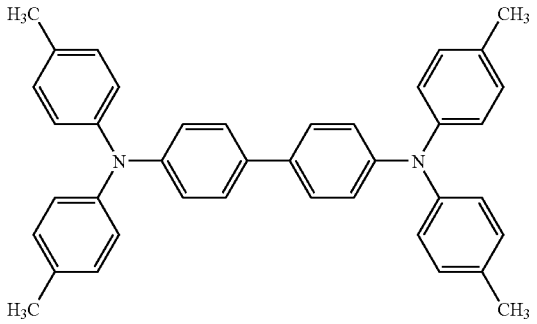

(I)

[Formula 2]

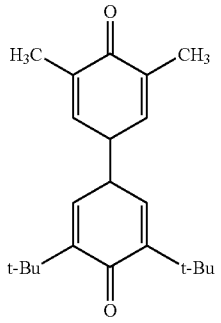

(II)

[Coating Liquid B1 for Charge-Generating Layer]

A coating liquid B1 for charge-generating layer was prepared in the same manner as in the coating liquid A1 for charge-generating layer, except for changing the amount of AEROSIL R972 used in the coating liquid A1 for charge-generating layer to 1 part by weight.

[Coating Liquid C1 for Charge-Generating Layer]

A coating liquid C1 for charge-generating layer was prepared in the same manner as in the coating liquid A1 for charge-generating layer, except for changing the amount of AEROSIL R972 used in the coating liquid A1 for charge-generating layer to 1.5 parts by weight.

[Coating Liquid D1 for Charge-Generating Layer]

A coating liquid D1 for charge-generating layer was prepared in the same manner as in the coating liquid A1 for charge-generating layer, except for changing the amount of AEROSIL R972 used in the coating liquid A1 for charge-generating layer to 3 parts by weight.

[Coating Liquid E1 for Charge-Generating Layer]

A coating liquid E1 for charge-generating layer was prepared in the same manner as in the coating liquid A1 for charge-generating layer, except for changing the amount of AEROSIL R972 used in the coating liquid A1 for charge-generating layer to 5 parts by weight.

[Coating Liquid A2 for Charge-Transporting Layer]

Materials shown in Table 3 were dispersed in a homogenizer for 10 minutes to prepare a coating liquid A2 for charge-transporting layer.

TABLE 3

| | |
|---|---|
| Hole-transporting material represented by the following structural formula (III): | 10 parts by weight |
| AEROSIL R974 (manufactured by Nippon Aerosil Co., Ltd.): | 1 part by weight |
| Polycarbonate resin Z200 (manufactured by Mitsubishi Gas Chemical Company, Inc.): | 20 parts by weight |
| Cyclohexanone: | 120 parts by weight |

[Formula 3]

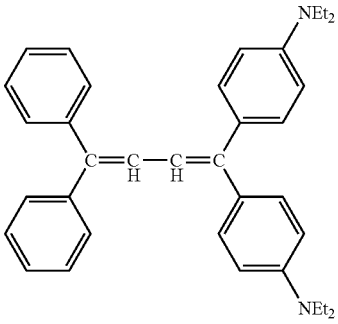

(III)

[Coating Liquid B2 for Charge-Transporting Layer]

A coating liquid B2 for charge-transporting layer was prepared in the same manner as in the coating liquid A2 for charge-transporting layer, except for changing the amount of AEROSIL R974 used in the coating liquid A2 for charge-transporting layer to 3 parts by weight.

[Coating Liquid C2 for Charge-Transporting Layer]

A coating liquid C2 for charge-transporting layer was prepared in the same manner as in the coating liquid A2 for charge-transporting Layer, except for changing the amount of AEROSIL R974 used in the coating liquid A2 for charge-transporting layer to 15 parts by weight.

[Coating Liquid D2 for Charge-Transporting Layer]

A coating liquid D2 for charge-transporting layer was prepared in the same manner as in the coating liquid A2 for charge-transporting layer, except for changing the amount of AEROSIL R974 used in the coating liquid A2 for charge-transporting layer to 30 parts by weight.

[Coating Liquid E2 for Charge-Transporting Layer]

A coating liquid E2 for charge-transporting layer was prepared in the same manner as in the coating liquid A2 for charge-transporting layer, except for changing the amount of AEROSIL R974 used in the coating liquid A2 for charge-transporting layer to 40 parts by weight.

Each of the thus prepared coating liquids was measured for dynamic viscoelasticity at a frequency sweep mode using a rotary rheometer AR1000 (manufactured by TA Instruments) at a measurement temperature of 20° C. using parallel plates having a diameter of 60 mm, thereby measuring a loss tangent tan δ at a frequency of 6.28 radians/sec. The results of measurement of the loss tangent tan δ are shown in Table 4.

TABLE 4

| Coating liquid | tan δ |
|---|---|
| Coating liquid A1 for charge-generating layer | 20 |
| Coating liquid B1 for charge-generating layer | 10 |

TABLE 4-continued

| Coating liquid | tan δ |
|---|---|
| Coating liquid C1 for charge-generating layer | 4 |
| Coating liquid D1 for charge-generating layer | 1 |
| Coating liquid E1 for charge-generating layer | 0.7 |
| Coating liquid A2 for charge-transporting layer | 30 |
| Coating liquid B2 for charge-transporting layer | 10 |
| Coating liquid C2 for charge-transporting layer | 3 |
| Coating liquid D2 for charge-transporting layer | 1 |
| Coating liquid E2 for charge-transporting layer | 0.8 |

(Application of Coating Liquid on Substrate for Electrophotographic Photoreceptor)

Using the coating apparatus 1, each of the coating liquids A1 to E1 for charge-generating layer and each of the coating liquids A2 to E2 for charge-transporting layer were applied to a substrate for electrophotographic photoreceptor to prepare electrophotographic photoreceptors of Examples 1 to 7 and electrophotographic photoreceptors of Comparative Examples 1 to 5.

An aluminum-made cylinder having a diameter of 30 mm, a length of 335 mm and a wall thickness of 1 mm was used as the substrate for electrophotographic photoreceptor. A silicone rubber roll having a diameter of 400 mm and a length of 400 mm was used as an applicator roll. A stainless steel-made roll having a diameter of 400 mm and a length of 400 mm was used as a coating liquid supplying roll.

A plurality of fine concaves in a quadrangular pyramid shape were closely formed on the surface of the coating liquid supplying roll over a region having a length of 335 mm in the axial direction of the roll to form a fine concave portion. The fine concaves in a quadrangular pyramid shape were formed so as to have dimensions of a base of the quadrangular pyramid of 60 μm×60 μm and a height of the quadrangular pyramid, i.e., a depth of the fine concave of 50 μm. Concave depth decreasing portions were formed in the circumferential ends of the fine concave portion, and in the concave depth decreasing portions, the depth of the fine concave portion was continuously changed from 50 μm to 0. The roll circumferential length L2 of the concave decreasing portion was set up at 10 mm.

Two coating liquid supplying rolls having the same material quality and the same size were prepared. That is, in the coating liquid supplying roll used in the case of coating the coating liquid for charge-generating layer, a fine concave portion was formed such that its effective length L was 60π (=2×30π) mm which is two times the circumference (30π mm) of the substrate for electrophotographic photoreceptor. Also, in the coating liquid supplying roll used in the case of coating the coating liquid for charge-transporting layer, a fine concave portion was formed such that its length was 150π (=5×30π) mm which is five times the circumference (30π mm) of the substrate for electrophotographic photoreceptor. That is, in the case of applying the coating liquid for charge-generating layer to the substrate for electrophotographic photoreceptor, wet-on-wet coating was carried out two times, and in the case of applying the coating liquid for charge-transporting layer to the substrate for electro-photoreceptor, wet-on-wet coating was carried out five times.

Electrophotographic Photoreceptor of Example 1

The coating liquid for charge-generating layer B1 was applied to the substrate for electrophotographic photoreceptor at a coating rate of 50 m/min and then dried at 130° C. for 20 minutes to form a charge-generating layer. The charge-generating layer had a thickness of 2 μm. The coating liquid C2 for charge-transporting layer was applied to the substrate for electrophotographic photoreceptor having the charge-generating layer formed thereon at a coating rate of 50 m/min and then dried at 130° C. for 60 minutes to form a charge-transporting layer. There was thus prepared an electrophotographic photoreceptor of Example 1. The photosensitive layer constructed of the charge-generating layer and the charge-transporting layer had a thickness of 22 μm.

Incidentally, with respect to the electrophotographic photoreceptor of Example 1 and respective electrophotographic photoreceptors prepared in the subsequent Examples, the thickness of the charge-generating layer and the thickness of the photosensitive layer constructed of the charge-generating layer and the charge-transporting layer were measured at the time of forming the charge-generating layer and at the time of forming the charge-transporting layer using a spectro multichannel photodetector MCPD-1100 (manufactured by Otsuka Electronics Co., Ltd.).

Electrophotographic Photoreceptor of Example 2

An electrophotographic photoreceptor of Example 2 was prepared in the same manner as in the electrophotographic photoreceptor of Example 1, except for using the coating liquid C1 for charge-generating layer to form a charge-generating layer. The charge-generating layer had a thickness of 2 μm, and the photosensitive layer had a thickness of 22 μm.

Electrophotographic Photoreceptor of Example 3

An electrophotographic photoreceptor of Example 3 was prepared in the same manner as in the electrophotographic photoreceptor of Example 1, except for using the coating liquid D1 for charge-generating layer to form a charge-generating layer. The charge-generating layer had a thickness of 2 μm, and the photosensitive layer had a thickness of 22 μm.

Electrophotographic Photoreceptor of Example 4

An electrophotographic photoreceptor of Example 4 was prepared in the same manner as in the electrophotographic photoreceptor of Example 2, except for using the coating liquid B2 for charge-transporting layer to form a charge-transporting layer. The charge-generating layer had a thickness of 2 μm, and the photosensitive layer had a thickness of 22 μm.

Electrophotographic Photoreceptor of Example 5

An electrophotographic photoreceptor of Example 5 was prepared in the same manner as in the electrophotographic photoreceptor of Example 2, except for using the coating liquid D2 for charge-transporting layer to form a charge-transporting layer. The charge-generating layer had a thickness of 2 μm, and the photosensitive layer had a thickness of 22 μm.

Electrophotographic Photoreceptor of Example 6

An electrophotographic photoreceptor of Example 6 was prepared in the same manner as in the electrophotographic photoreceptor of Example 2, except for changing the coating rate in applying the coating liquid for charge-generating layer and the coating rate in applying the coating liquid for charge-transporting layer to 10 m/min, respectively. The charge-generating layer had a thickness of 2 μm, and the photosensitive layer had a thickness of 22 μm.

Electrophotographic Photoreceptor of Example 7

An electrophotographic photoreceptor of Example 7 was prepared in the same manner as in the electrophotographic photoreceptor of Example 2, except for changing the coating rate in applying the coating liquid for charge-generating layer and the coating rate in applying the coating liquid for charge-transporting layer to 300 m/min, respectively. The charge-generating layer had a thickness of 2 μm, and the photosensitive layer had a thickness of 22 μm.

Figure 11B:
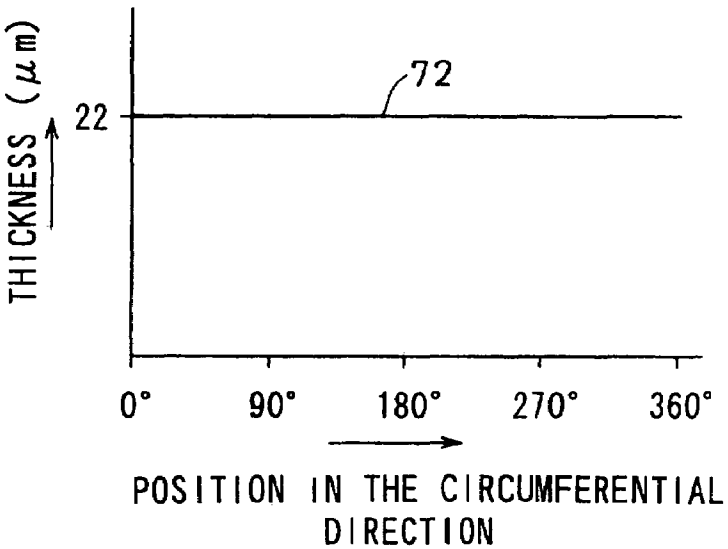
FIGS. 11A and 11B are views showing the thickness in the circumferential direction of an electrophotographic photoreceptor of Example 1.
Figure 11A:
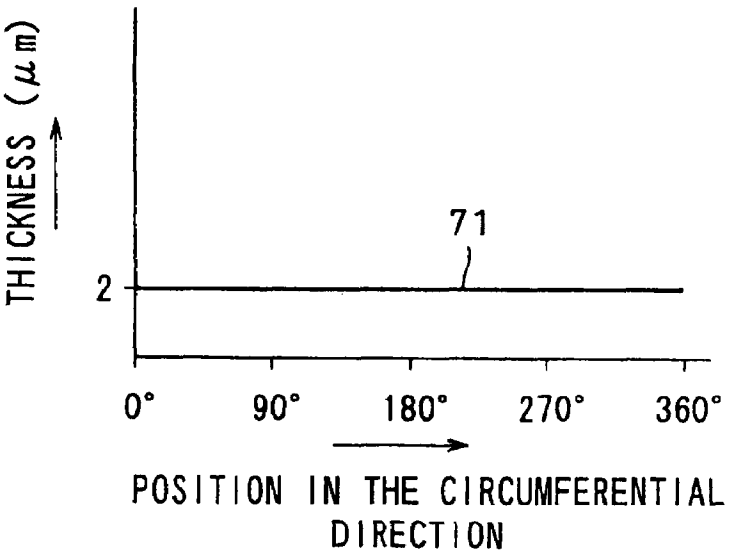

FIGS. 11A and 11B are views showing the thickness in the circumferential direction of the electrophotographic photoreceptor of Example 1. In FIG. 11A, a line 71 shows the results of measurement of the thickness in the circumferential direction of the charge-generating layer at the point of time of forming the charge-generating layer; and in FIG. 11B, a line 72 shows the results of measurement of the thickness in the circumferential direction of the photosensitive layer resulting from addition of the thickness of the charge-generating layer and the thickness of the charge-transporting layer at the point of time of forming the charge-transporting layer. Incidentally, since the results of measurement of the thickness of each of the electrophotographic photoreceptors of Examples 2 to 7 showed the same tendency as in the results of measurement of the thickness of the electrophotographic photoreceptor of Example 1, they are represented by the measurement results of the electrophotographic photoreceptor of Example 1, and illustration thereof is omitted. As shown in FIGS. 11A and 11B, according to the electrophotographic photoreceptors of the Examples, electrophotographic photoreceptors that are free from unevenness of the thickness, are seamless and have uniform and good coating film quality in both the charge-generating layer and the photosensitive layer, i.e., the charge-transporting layer could be prepared.

Electrophotographic Photoreceptor of Comparative Example 1

Figure 12A:
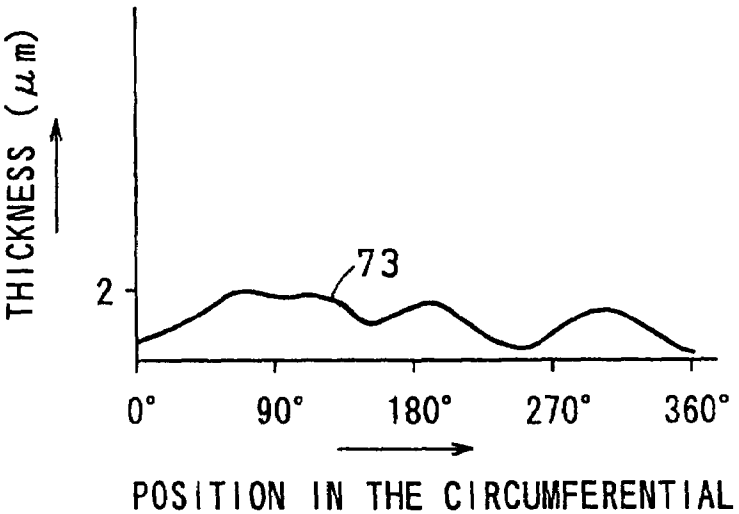
FIGS. 12A and 12B are views showing the thickness in the circumferential direction of an electrophotographic photoreceptor of Comparative Example 1.
Figure 12B:
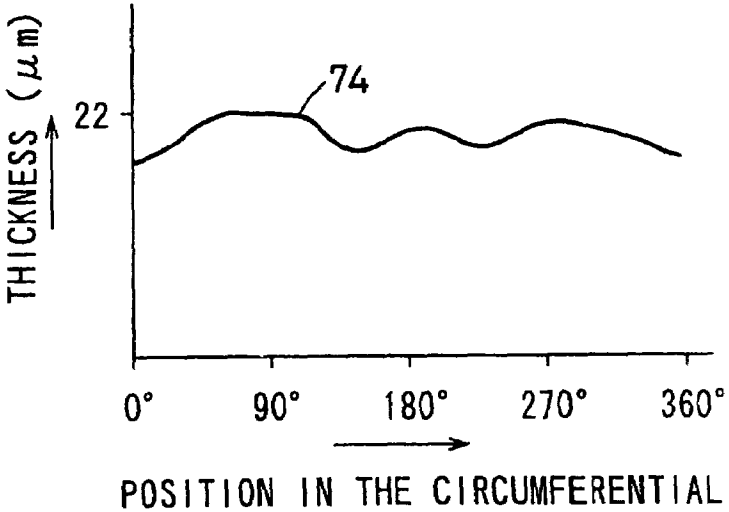

An electrophotographic photoreceptor of Comparative Example 1 was prepared in the same manner as in the electrophotographic photoreceptor of Example 1, except for using the coating liquid A1 for charge-generating layer to form a charge-generating layer. FIGS. 12A and 12B are views showing the thickness in the circumferential direction of the electrophotographic photoreceptor of Comparative Example 1. In FIG. 12A, a line 73 shows the results of measurement of the thickness in the circumferential direction of the charge-generating layer; and in FIG. 12B, a line 74 shows the results of measurement of the thickness in the circumferential direction of the photosensitive layer. Though no seam was generated in all of the charge-generating layer and the photosensitive layer, the thickness of the charge-generating layer varied within the range of from 0.1 μm to 2 μm; the thickness of the photosensitive layer varied within the range of from 20 μm to 22 μm; and unevenness of the thickness caused by the variation of the thickness of the charge-generating layer was generated.

Electrophotographic Photoreceptor of Comparative Example 2

Figure 13A:
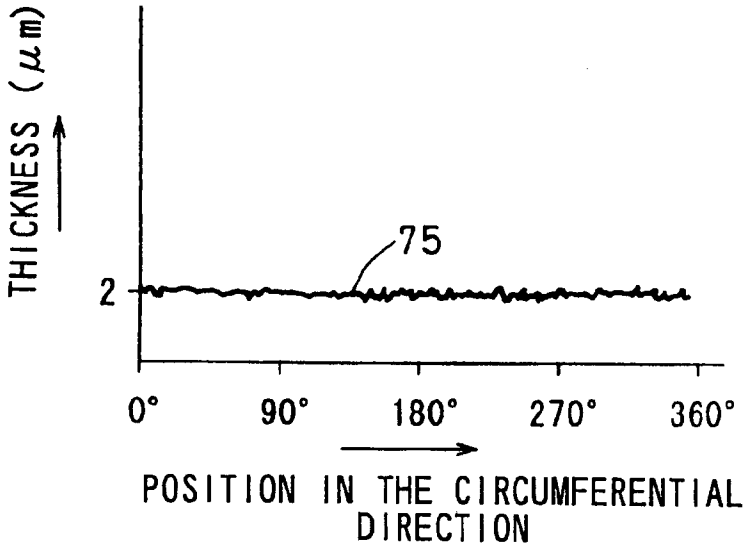
FIGS. 13A and 13B are views showing the thickness in the circumferential direction of an electrophotographic photoreceptor of Comparative Example 2.
Figure 13B:
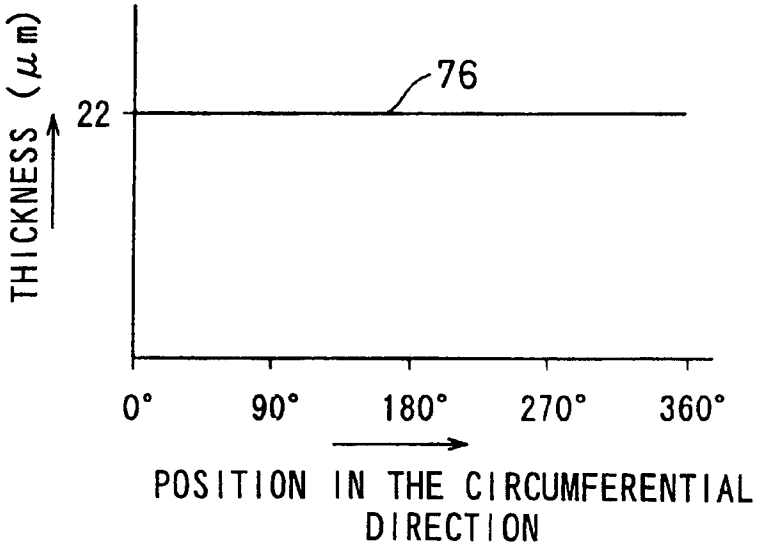

An electrophotographic photoreceptor of Comparative Example 2 was prepared in the same manner as in the electrophotographic photoreceptor of Example 1, except for using the coating liquid E1 for charge-generating layer to form a charge-generating layer. FIGS. 13A and 13B are views showing the thickness in the circumferential direction of the electrophotographic photoreceptor of Comparative Example 2. In FIG. 13A, a line 75 shows the results of measurement of the thickness in the circumferential direction of the charge-generating layer; and in FIG. 13B, a line 76 shows the results of measurement of the thickness in the circumferential direction of the photosensitive layer. The macro thickness of the charge-generating layer was 2 μm; and the thickness of the photosensitive was 22 μm, and its macro thickness was uniform. However, the generation of fine unevenness of the thickness caused by the fine concaves of the coating liquid supplying roll was found in the coating film of the charge-generating layer.

Electrophotographic Photoreceptor of Comparative Example 3

Figure 14A:
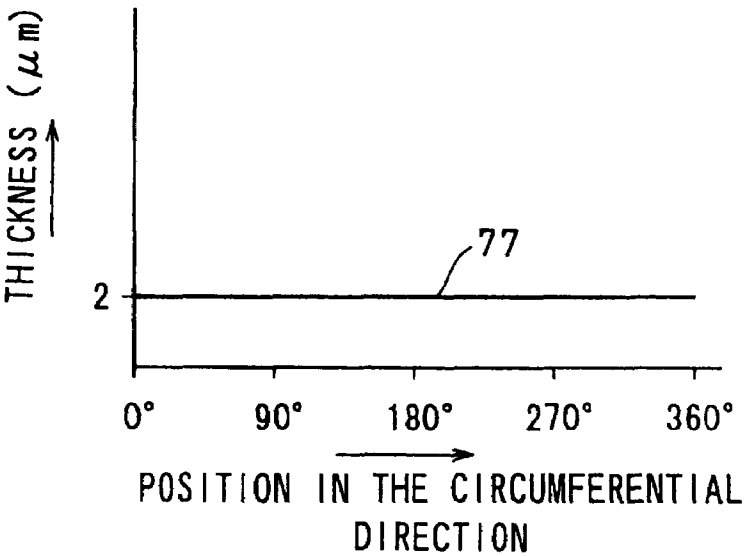
FIGS. 14A and 14B are views showing the thickness in the circumferential direction of an electrophotographic photoreceptor of Comparative Example 3.
Figure 14B:
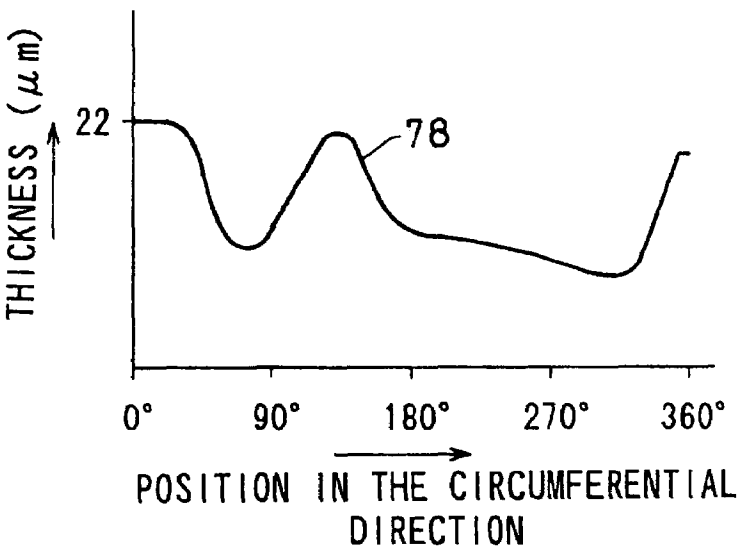

An electrophotographic photoreceptor of Comparative Example 3 was prepared in the same manner as in the electrophotographic photoreceptor of Example 2, except for using the coating liquid A2 for charge-transporting layer to a charge-transporting layer. FIGS. 14A and 14B are views showing the thickness in the circumferential direction of the electrophotographic photoreceptor of Comparative Example 3. In FIG. 14A, a line 77 shows the results of measurement of the thickness in the circumferential direction of the charge-generating layer; and in FIG. 14B, a line 78 shows the results of measurement of the thickness in the circumferential direction of the photosensitive layer. Though the thickness of the charge-generating layer was 2 μm and substantially uniform, the thickness of the photosensitive layer varied within the range of from 10 μm to 22 μm, and unevenness of the thickness of the charge-transporting layer was generated.

Electrophotographic Photoreceptor of Comparative Example 4

Figure 15B:
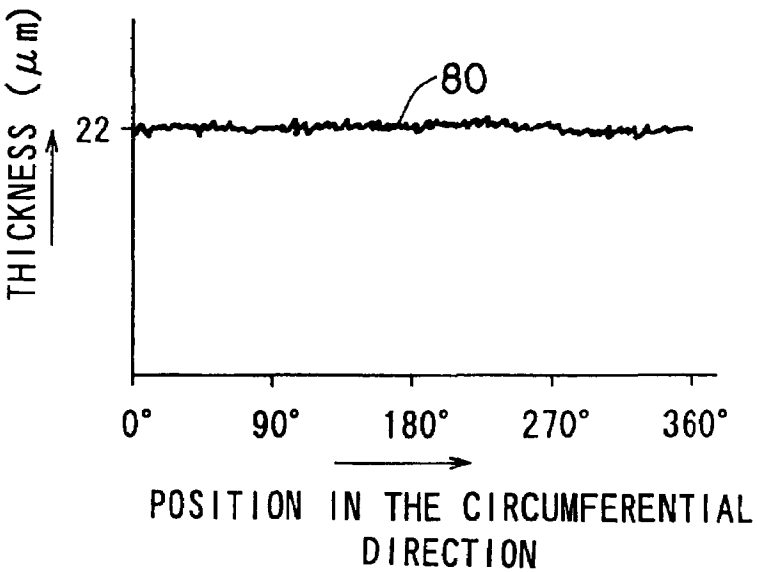
FIGS. 15A and 15B are views showing the thickness in the circumferential direction of an electrophotographic photoreceptor of Comparative Example 4.
Figure 15A:
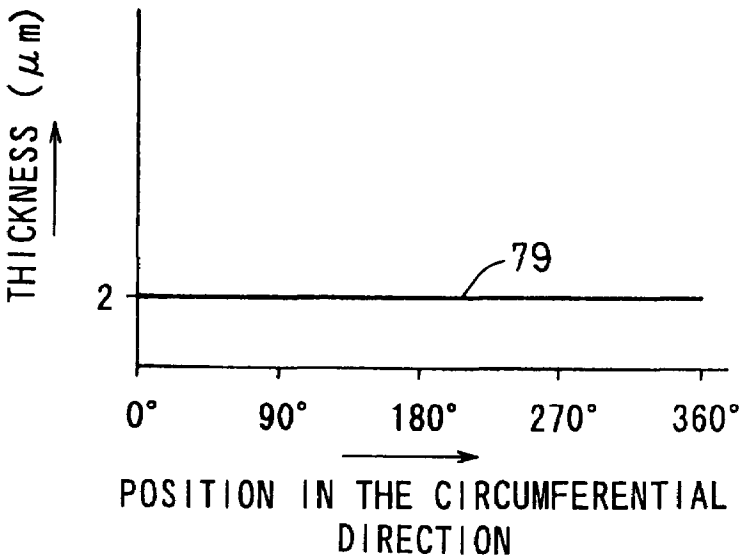

An electrophotographic photoreceptor of Comparative Example 4 was prepared in the same manner as in the electrophotographic photoreceptor of Example 2, except for using the coating liquid E2 for charge-transporting layer to a charge-transporting layer. FIGS. 15A and 15B are views showing the thickness in the circumferential direction of the electrophotographic photoreceptor of Comparative Example 4. In FIG. 15A, a line 79 shows the results of measurement of the thickness in the circumferential direction of the charge-generating layer; and in FIG. 15B, a line 80 shows the results of measurement of the thickness in the circumferential direction of the photosensitive layer. The thickness of the charge-generating layer was 2 μm and substantially uniform. Though the thickness of the photosensitive layer was 22 μm and unevenness of the macro thickness was not generated, a film in which the surface of the charge-transporting layer was cloudy was formed. It is assumed that this was caused by the matter that patterns of the fine concaves of the coating liquid supplying roll remained on the surface of the charge-transporting layer due to insufficient leveling.

Electrophotographic Photoreceptor of Comparative Example 5

Figure 16:
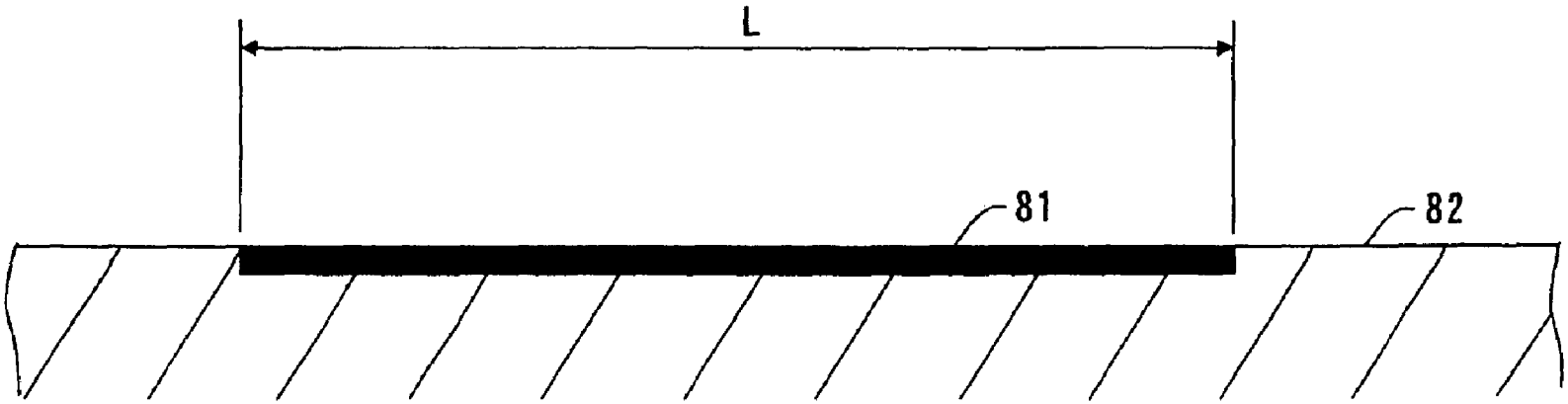
FIG. 16 is a circumferential development elevation in the vicinity of the surface of a coating liquid supplying roll.
Figure 17B:
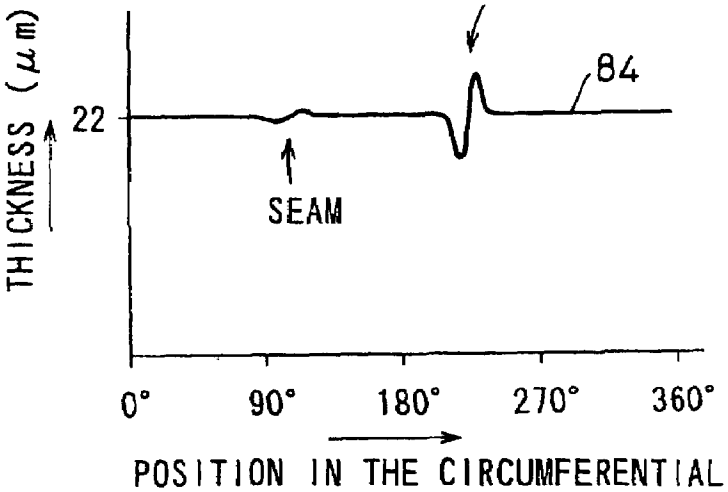
FIGS. 17A and 17B are views showing the thickness in the circumferential direction of an electrophotographic photoreceptor of Comparative Example 5.
Figure 17A:
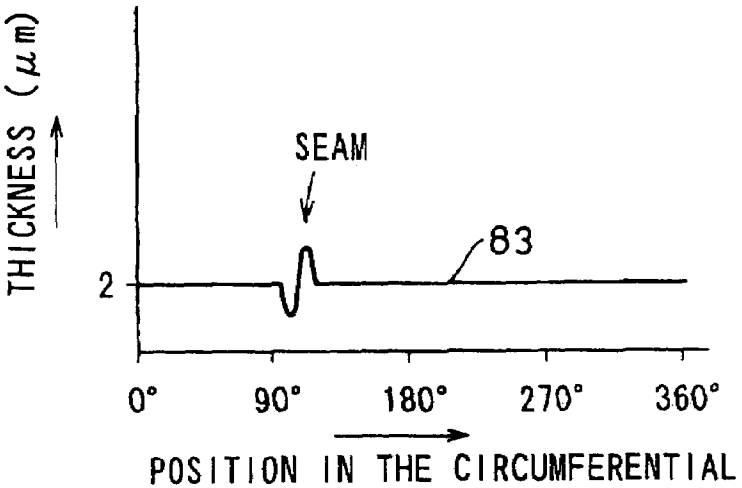

Only with respect to an electrophotographic photoreceptor of Comparative Example 5, the electrophotographic photoreceptor of Comparative Example 5 was prepared in the same manner as in the electrophotographic photoreceptor of Example 2, except for separately preparing a coating liquid supplying roll 82 in which no concave depth decreasing portion was formed in the both circumferential ends of a fine concave portion 81 as shown in FIG. 16 and using this coating liquid supplying roll 82. FIGS. 17A and 17B are views showing the thickness in the circumferential direction of the electrophotographic photoreceptor of Comparative Example 5. In FIG. 17A, a line 83 shows the results of measurement of the thickness in the circumferential direction of the charge-generating layer; and in FIG. 17B, a line 84 shows the results of measurement of the thickness in the circumferential direction of the photosensitive layer. The charge-generating layer had a thickness of 2 μm, and the photosensitive layer had a thickness of 22 μm. However, a seam was generated in both the charge-generating layer and the charge-transporting layer, and a coating film defect extending in the stripe-like shape in the circumferential direction was observed in the seam portion.

(Image Quality Evaluation Test)

Each of the electrophotographic photoreceptors of Examples 1 to 7 and the electrophotographic photoreceptors of Comparative Examples 1 to 5 was installed in a digital copier AR-M450, manufactured by Sharp Kabushiki Kaisha, and an overall halftone image was formed. The image quality was evaluated by visually observing unevenness of the density and unevenness of the image in the formed halftone image.

The evaluation results are summarized and shown in Table 5. In the images by the electrophotographic photoreceptors of Examples 1 to 7, images having good quality were formed without generating unevenness of the density and unevenness of the image. On the other hand, in the electrophotographic photoreceptors of Comparative Examples 1 to 5, unevenness of the density and unevenness of the image in the stripe-like shape were generated, and the images were an image that is problematic in the practical use.

TABLE 5

| Electrophotographic photoreceptor | Evaluation results of image quality |
|---|---|
| Examples 1 to 7 | The image quality was good. Unevenness of the density and unevenness of the image were not generated. |
| Comparative Example 1 | Unevenness of the halftone density seemed to be caused by unevenness of the thickness of the charge-generating layer was generated. |
| Comparative Example 2 | Fine evenness of the density in the granular state was generated in the seam portion of the charge-generating layer. Fine unevenness of the halftone density was also generated in other portions. |
| Comparative Example 3 | Unevenness of the halftone density seemed to be caused by unevenness of the thickness of the charge-transporting layer was generated. |
| Comparative Example 4 | Light and shade unevenness was generated in the seam portion of the charge-transporting layer. |
| Comparative Example 5 | Unevenness of the image in the stripe-like shape was generated in the circumferential direction of the electrophotographic photoreceptor in the seam portion between the charge-generating layer and the charge-transporting layer. |

In the light of the above, in the embodiment, though the shape of the fine concaves 8*a* to be formed on the coating liquid supplying roll 5 is in a quadrangular pyramid shape, the invention is not limited thereto. In the invention, it may be semi-spherical or in other shapes.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An apparatus for applying a coating liquid to a cylindrical substrate, comprising:

an applicator roll for applying a coating liquid to a cylindrical substrate, the applicator roll being provided so as to come into contact with the cylindrical substrate;

a coating liquid supplying roll for supplying the coating liquid to the applicator roll, the coating liquid supplying roll having a portion of fine concaves in at least a part of a circumferential length thereof, the portion of fine concaves comprising a plurality of fine concaves arranged two dimensionally, and the portion of fine concaves being formed in such a manner that depths of the fine concaves in vicinities of both circumferential ends of the portion of fine concaves decrease as they become far from a center in a circumferential direction of the portion of fine concaves; and a coating liquid amount-control member for controlling an amount of the coating liquid attached onto a surface of the coating liquid supplying roll, wherein in the portion of fine concaves of the coating liquid supplying roll, a sum L (=L1+L2) of a circumferential length L1 of a portion in which fine concaves are formed in substantially a same depth and a circumferential length L2 of one of portions in which fine concaves are formed in such a manner that the depth decreases, is n times of a circumference Lc of the cylindrical substrate, wherein n is an integer of 1 or more.

2. The apparatus of claim 1, wherein the fine concaves are formed in a quadrangular pyramid shape.

* * * * *